US008596210B2

(12) United States Patent
Tokura

(10) Patent No.: US 8,596,210 B2
(45) Date of Patent: Dec. 3, 2013

(54) SEWING MACHINE AND COMPUTER-READABLE MEDIUM STORING CONTROL PROGRAM EXECUTABLE ON SEWING MACHINE

(75) Inventor: Masashi Tokura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 947 days.

(21) Appl. No.: 12/659,224

(22) Filed: Mar. 1, 2010

(65) Prior Publication Data

US 2010/0242817 A1 Sep. 30, 2010

(30) Foreign Application Priority Data

Mar. 27, 2009 (JP) ..... 2009-078022
Sep. 3, 2009 (JP) ..... 2009-203638

(51) Int. Cl.
*D05B 21/00* (2006.01)

(52) U.S. Cl.
USPC ..... 112/470.06

(58) Field of Classification Search
USPC ..... 112/470.01, 470.03, 470.06, 475.18, 112/475.19, 102.5; 700/136, 137, 138
See application file for complete search history.

(56) References Cited

U.S. PATENT DOCUMENTS 5,537,945 A 7/1996 Sugihara et al.
5,911,182 A * 6/1999 Uyama et al. ..... 112/102.5
5,943,972 A 8/1999 Hirata
6,167,822 B1 1/2001 Miyasako et al.
7,290,492 B2 11/2007 Watanabe et al.
7,538,798 B2 * 5/2009 Mizusawa ..... 348/222.1
7,854,207 B2 12/2010 Kuki et al.
8,061,286 B2 * 11/2011 Hirata et al. ..... 112/470.01
2007/0199492 A1 8/2007 Ishii
2009/0020054 A1 1/2009 Taguchi et al.
2009/0188413 A1 7/2009 Hirata et al.
2009/0188414 A1 7/2009 Tokura

FOREIGN PATENT DOCUMENTS

JP U-58-117795 8/1983
JP A-63-177894 7/1988
JP H-5-38703 9/1993
JP A-6-205885 7/1994

(Continued)

OTHER PUBLICATIONS

U.S. Appl. No. 12/857,147, filed Aug. 16, 2010, in the name of Masashi Tokura.

(Continued)

*Primary Examiner* — Tejash Patel
(74) *Attorney, Agent, or Firm* — Oliff & Berridge, PLC

(57) ABSTRACT

A sewing machine that is capable of sewing an embroidery pattern includes a transfer device that transfers the embroidery frame, a storage device that stores embroidery data, a first selection device that selects first embroidery data, a first control device that performs sewing of the first pattern, an image capture device that captures an image, a first detection device that detects at least one of a marker position and a marker angle based on information for a first image, a second detection device that detects at least one of the marker position and the marker angle based on information for a second image, a difference computation device that computes at least one of a position difference and an angle difference, a second selection device that selects second embroidery data, a conversion device that converts coordinate data, and a second control device that performs sewing of the second pattern.

5 Claims, 18 Drawing Sheets

(56) References Cited

FOREIGN PATENT DOCUMENTS

| | | |
|---|---|---|
| JP | A-6-339588 | 12/1994 |
| JP | A-7-255968 | 10/1995 |
| JP | A-10-137467 | 5/1998 |
| JP | A-11-99294 | 4/1999 |
| JP | A-11-229262 | 8/1999 |
| JP | A-11-244561 | 9/1999 |
| JP | A-2003-71176 | 3/2003 |
| JP | A-2004-180993 | 7/2004 |
| JP | A-2005-74117 | 3/2005 |
| JP | A-2006-130124 | 5/2006 |
| JP | A-2007-105138 | 4/2007 |
| JP | A-2009-22400 | 2/2009 |
| JP | A-2009-172119 | 8/2009 |
| JP | A-2009-172123 | 8/2009 |
| WO | WO 2009/085005 A1 | 7/2009 |

OTHER PUBLICATIONS

U.S. Appl. No. 12/847,527, filed Jul. 30, 2010, in the name of Masashi Tokura.

U.S. Appl. No. 12/847,540, filed Jul. 30, 2010, in the name of Masashi Tokura.

Japanese Office Action issued in Japanese Patent Application No. 2009-203638 (with translation).

European Search Report issued in European Application No. 10153687.8 on Jul. 15, 2011.

Japanese Office Action issued in Japanese Application No. 2009-203649 on Jul. 26, 2011 (with translation).

* cited by examiner

FIG. 6

2021

| EMBROIDERY PATTERN | FIRST EMBROIDERY DATA | SECOND EMBROIDERY DATA |
|---|---|---|
| A | FIRST E1 DATA | SECOND E1 DATA |
| B | FIRST E2 DATA | SECOND E2 DATA |
| : | : | : |

SEWING MACHINE AND COMPUTER-READABLE MEDIUM STORING CONTROL PROGRAM EXECUTABLE ON SEWING MACHINE

CROSS-REFERENCE TO RELATED APPLICATION

This application claims priority to Japanese Patent Application Nos. 2009-078022, filed Mar. 27, 2009, and 2009-203638, filed Sep. 3, 2009, the content of which is hereby incorporated herein by reference in its entirety.

BACKGROUND

The present disclosure relates to a sewing machine and a computer-readable medium that stores a control program executable on a sewing machine. More specifically, the present disclosure relates to a sewing machine and a computer-readable medium that stores a control program executable on a sewing machine that allows alignment of a work cloth in embroidery sewing.

In a known sewing machine that is capable of embroidery sewing, an embroidery pattern may extend beyond an embroidery area of an embroidery frame, due to a combination of sizes of the embroidery pattern and the embroidery frame. In such a case, the embroidery pattern is divided into a plurality of sub-patterns, and is sewn in several batches. This makes it necessary for a user to reposition the work cloth in the embroidery frame so that the sub-patterns of the embroidery pattern may be separately sewn.

A sewing machine is known that prevents misalignment in relative positions of a sub-pattern that has already been sewn on a work cloth and a sub-pattern that will be newly sewn. For example, a sewing machine is known in which reference marks are sewn in a plurality of positions on a work cloth. When a user repositions the work cloth, positions of the sewn reference marks may be aligned with positions of reference marks that are provided on the embroidery frame. Thus the relative positions of the sub-pattern that has already been sewn and the sub-pattern that will be newly sewn may be aligned.

SUMMARY

In the sewing machine that is described above, the user must visually align the positions of the sewn reference marks with the positions of reference marks that are provided on the embroidery frame. Accordingly, it may be difficult to set the work cloth accurately in the embroidery frame. Therefore, a position of the embroidery pattern after the work cloth has been repositioned may not be accurately aligned in relation to a position of the embroidery pattern before the work cloth is repositioned.

Various exemplary embodiments of the broad principles derived herein provide a sewing machine and a computer-readable medium that stores a control program executable on a sewing machine that are capable of accurately aligning relative positions of an embroidery pattern before and after a work cloth is repositioned.

Exemplary embodiments provide a sewing machine that is capable of sewing an embroidery pattern on a work cloth that is held by an embroidery frame. The sewing machine includes a transfer device that transfers the embroidery frame detachably attached thereto, a storage device that stores embroidery data that is data for sewing the embroidery pattern and that includes at least coordinate data that indicates a plurality of needle drop positions in relation to a reference position, each of the plurality of needle drop positions being a point where a needle pierces the work cloth, a first selection device that selects first embroidery data from the embroidery data that is stored in the storage device, the first embroidery data being embroidery data for a first pattern that is at least a portion of the embroidery pattern, and a first control device that performs sewing of the first pattern on the work cloth by controlling the transfer device based on the first embroidery data that was selected by the first selection device. The sewing machine further includes an image capture device that captures an image of the work cloth onto which a marker that can be affixed onto the work cloth is affixed, a first detection device that detects at least one of a marker position and a marker angle based on information for a first image, the marker position being a position of the marker that has been affixed onto the work cloth in relation to the reference position, the marker angle being an angle of the marker in relation to a reference direction, and the first image being an image captured by the image capture device of the work cloth on which the first pattern has been sewn by the first control device, and a second detection device that detects at least one of the marker position and the marker angle based on information for a second image, the second image being an image captured by the image capture device of the work cloth one of after a position of the work cloth on which the first pattern has been sewn has been changed in relation to the embroidery frame and after a position of the embroidery frame that holds the work cloth on which the first pattern has been sewn has been changed in relation to the transfer device. The sewing machine also includes a difference computation device that computes at least one of a position difference and an angle difference, the position difference being a difference between the marker position that was detected by the first detection device and the marker position that was detected by the second detection device, and the angle difference being a difference between the marker angle that was detected by the first detection device and the marker angle that was detected by the second detection device, a second selection device that selects second embroidery data from the embroidery data that is stored in the storage device, the second embroidery data being embroidery data for a second pattern that is at least a portion of the embroidery pattern and that is adjacent to the first pattern, a conversion device that converts coordinate data in the second embroidery data based on the at least one of the position difference and the angle difference that was computed by the difference computation device, and a second control device that performs sewing of the second pattern on the work cloth on which the first pattern has been sewn by controlling the transfer device based on the second embroidery data that includes the coordinate data that was converted by the conversion device.

Exemplary embodiments further provide a computer-readable medium storing a control program executable on a sewing machine that is capable of sewing an embroidery pattern on a work cloth that is held by an embroidery frame. The program includes instructions that cause a computer to perform the steps of selecting first embroidery data from embroidery data that is data for sewing the embroidery pattern and that includes at least coordinate data that indicates a plurality of needle drop positions in relation to a reference position, the first embroidery data being embroidery data for a first pattern that is at least a portion of the embroidery pattern, and each of the plurality of needle drop positions being a point where a needle pierces the work cloth, and performing sewing of the first pattern on the work cloth by controlling a transfer device based on the selected first embroidery data, the transfer device transferring the embroidery frame detachably attached thereto. The program further includes instructions that cause the computer to perform the steps of detecting at least one of a marker position and a marker angle based on information for a first image, the marker position being a position of the marker that has been affixed onto the work cloth in relation to the reference position, the marker angle being an angle of the marker in relation to a reference direction, and the first image being a captured image of the work cloth on which the first pattern has been sewn, and detecting at least one of the marker position and the marker angle based on information for a second image, the second image being a captured image of the work cloth one of after a position of the work cloth on which the first pattern has been sewn has been changed in relation to the embroidery frame and after a position of the embroidery frame that holds the work cloth on which the first pattern has been sewn has been changed in relation to the transfer device. The program also includes instructions that cause the computer to perform the steps of computing at least one of a position difference and an angle difference, the position difference being a difference between the marker position that was detected based on the information for the first image and the marker position that was detected based on the information for the second image, and the angle difference being a difference between the marker angle that was detected based on the information for the first image and the marker angle that was detected based on the information for the second image, selecting a second embroidery data from the embroidery data, the second embroidery data being embroidery data for a second pattern that is at least a portion of the embroidery pattern and that is adjacent to the first pattern, converting coordinate data in the second embroidery data based on the at least one of the computed position difference and the computed angle difference, and performing sewing of the second pattern on the work cloth on which the first pattern has been sewn by controlling the transfer device based on the second embroidery data that includes the converted coordinate data.

Exemplary embodiments also provide a sewing machine that is capable of sewing an embroidery pattern on a work cloth that is held by an embroidery frame. The sewing machine includes transfer means for transferring the embroidery frame detachably attached thereto, storage means for storing embroidery data that is data for sewing the embroidery pattern and that includes at least coordinate data that indicates a plurality of needle drop positions in relation to a reference position, each of the plurality of needle drop positions being a point where a needle pierces the work cloth, first selection means for selecting first embroidery data from the embroidery data that is stored in the storage means, the first embroidery data being embroidery data for a first pattern that is at least a portion of the embroidery pattern, and first control means for performing sewing of the first pattern on the work cloth by controlling the transfer means based on the first embroidery data that was selected by the first selection means. The sewing machine further includes image capture means for capturing an image of the work cloth onto which a marker that can be affixed onto the work cloth is affixed, first detection means for detecting at least one of a marker position and a marker angle based on information for a first image, the marker position being a position of the marker that has been affixed onto the work cloth in relation to the reference position, the marker angle being an angle of the marker in relation to a reference direction, and the first image being an image captured by the image capture means of the work cloth on which the first pattern has been sewn by the first control means, and second detection means for detecting at least one of the marker position and the marker angle based on information for a second image, the second image being an image captured by the image capture means of the work cloth one of after a position of the work cloth on which the first pattern has been sewn has been changed in relation to the embroidery frame and after a position of the embroidery frame that holds the work cloth on which the first pattern has been sewn has been changed in relation to the transfer means. The sewing machine also includes difference computation means for computing at least one of a position difference and an angle difference, the position difference being a difference between the marker position that was detected by the first detection means and the marker position that was detected by the second detection means, and the angle difference being a difference between the marker angle that was detected by the first detection means and the marker angle that was detected by the second detection means, second selection means for selecting second embroidery data from the embroidery data that is stored in the storage means, the second embroidery data being embroidery data for a second pattern that is at least a portion of the embroidery pattern and that is adjacent to the first pattern, conversion means for converting coordinate data in the second embroidery data based on the at least one of the position difference and the angle difference that was computed by the difference computation means, and second control means for performing sewing of the second pattern on the work cloth on which the first pattern has been sewn by controlling the transfer means based on the second embroidery data that includes the coordinate data that was converted by the conversion means.

BRIEF DESCRIPTION OF THE DRAWINGS

Exemplary embodiments will be described below in detail with reference to the accompanying drawings in which:

FIG. 6 is a conceptual diagram that shows an embroidery data table;

DETAILED DESCRIPTION

Figure 1:
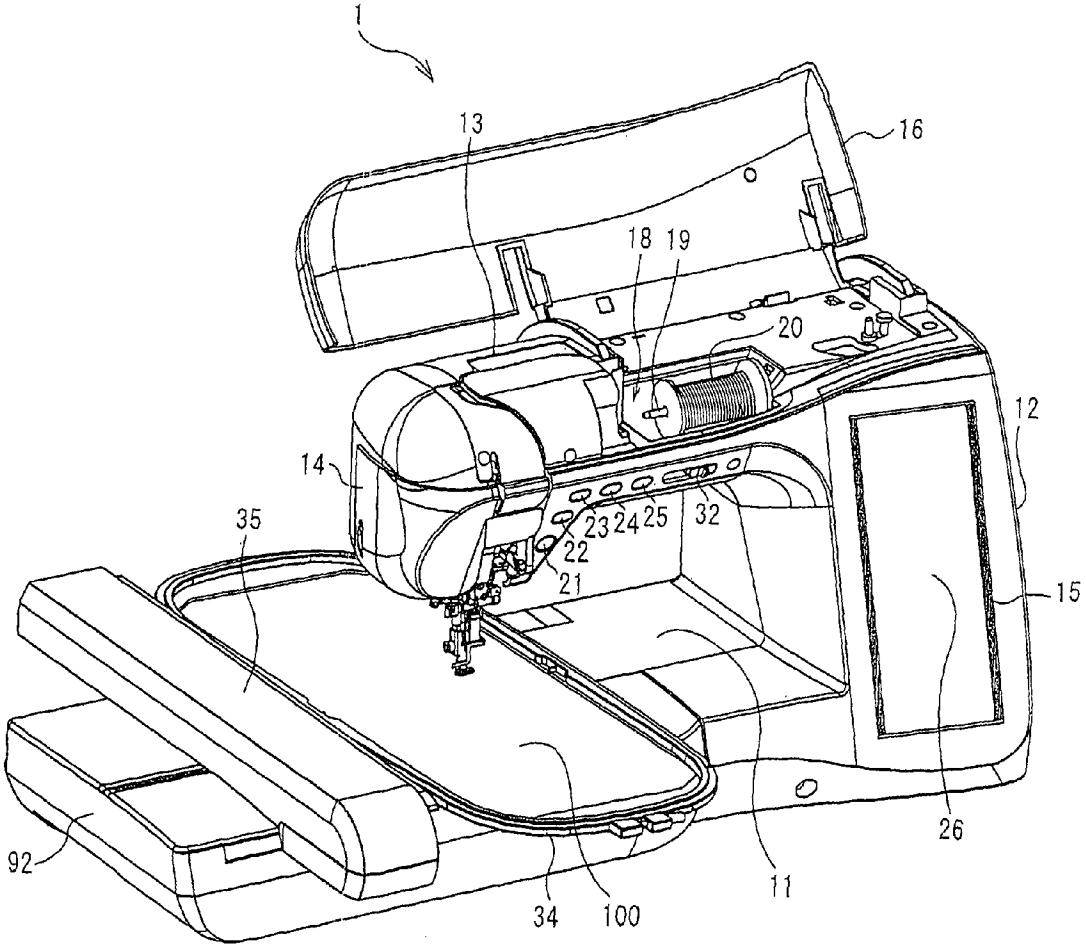
FIG. 1 is an oblique view of a sewing machine that is seen from the left front.

Hereinafter, an embodiment will be explained with reference to the drawings. A configuration of a sewing machine 1 will be explained with reference to FIGS. 1 and 2. In FIG. 1, the side of the sewing machine 1 that faces toward a user is referred to as the "front side," and the opposite side is referred to as the "rear side." The right side and the left side of the sewing machine 1 as viewed from the user are respectively referred to as the "right side" and the "left side."

As shown in FIG. 1, the sewing machine 1 is provided with a bed 11, a pillar 12, an arm 13, and a head 14. The bed 11 extends in the right-left direction. The pillar 12 extends upward from the right end of the bed 11. The arm 13 extends to the left from the upper end of the pillar 12. The head 14 is provided in the left end portion of the arm 13. A needle plate (not shown in the drawings) is provided on the top face of the bed 11. A feed dog (not shown in the drawings), a cloth feed mechanism (not shown in the drawings), a feed adjustment pulse motor 78 (refer to FIG. 3), and a shuttle mechanism (not shown in the drawings) are provided within the bed 11 underneath the needle plate. The feed dog feeds a work cloth to be sewn by a specified feed distance. The cloth feed mechanism drives the feed dog. The feed adjustment pulse motor 78 adjusts the feed distance.

An embroidery frame 34 that holds a work cloth 100 is disposed on the bed 11. The area within the embroidery frame 34 is an embroidery area in which a stitch of an embroidery pattern may be formed. An embroidery frame transfer unit 92 that transfers the embroidery frame 34 may be attached to and detached from the bed 11. A carriage cover 35 that extends in the front-rear direction is provided on the embroidery frame transfer unit 92. The carriage cover 35 contains a Y-axis transfer mechanism (not shown in the drawings). The Y-axis transfer mechanism transfers a carriage (not shown in the drawings) in a Y direction (the front-rear direction). The embroidery frame 34 may be attached to and detached from the carriage. A frame attachment portion (not shown in the drawings) on which the embroidery frame 34 is attached is provided on the right side of the carriage. The frame attachment portion projects outward to the right from the right side face of the carriage cover 35. An attaching portion (not shown in the drawings) that is provided on the left side of the embroidery frame 34 may be attached to the frame attachment portion. The carriage, the Y-axis transfer mechanism, and the carriage cover 35 are transferred in the X direction (the right-left direction) by an X-axis transfer mechanism (not shown in the drawings). The X-axis transfer mechanism is provided within the main body of the embroidery frame transfer unit 92. Thus the embroidery frame 34 is transferred in the X direction. The X-axis transfer mechanism and the Y-axis transfer mechanism are respectively driven by an X-axis motor 83 (refer to FIG. 3) and a Y-axis motor 84 (refer to FIG. 3). A needle bar 6 (refer to FIG. 2) and the shuttle mechanism (not shown in the drawings) are driven while the embroidery frame 34 is transferred in the X direction and the Y direction. In this manner, a pattern formation operation is performed that forms a pattern such as a stitch, an embroidery pattern, or the like in the work cloth 100 that is held by the embroidery frame 34. In a case where an ordinary pattern, instead of an embroidery pattern, is sewn, the embroidery frame transfer unit 92 may be detached from the bed 11. Ordinary sewing is then performed while the work cloth is fed by the feed dog. The embroidery frame 34 has a known configuration in which the work cloth 100 is held by being clamped between an inner frame and an outer frame, so a detailed explanation will be omitted.

The front face of the pillar 12 is provided with a liquid crystal display 15 that has a vertically long rectangular shape. Illustrations and names of commands that cause various types of commands to be executed are displayed on the liquid crystal display 15. The various types of commands may be used, for example, to set and edit various patterns and to control the sewing work. Various types of set values that pertain to sewing, various types of messages, and the like are displayed on the liquid crystal display 15.

A touch panel 26 is provided on the front face of the liquid crystal display 15. Names for a plurality of patterns, function names for executing various types of functions, numerical values in various types of setting screens, and the like may be displayed on the liquid crystal display 15. By using one of a finger and a special touch pen to touch a position on the touch panel 26 that corresponds to one of a pattern display portion and a setting portion on a screen that is displayed on the liquid crystal display 15, the user may select a sewing pattern, instruct a function to be executed, set a numerical value, and the like. Hereinafter, an operation of touching the touch panel 26 is referred to as a "panel operation."

A configuration of the arm 13 will be explained. A top cover 16 to be opened and closed is attached to the top of the arm 13. The top cover 16 is provided in the longitudinal direction of the arm 13. The top cover 16 is axially supported at the rear upper edge of the arm 13 such that the top cover 16 may be opened and closed around the right-left directional axis. A thread spool housing 18 is provided close to the middle of the top of the arm 13 under the top cover 16. The thread spool housing 18 is a recessed portion for housing a thread spool 20 that supplies a thread to the sewing machine 1. A spool pin 19, which projects toward the head 14, is disposed on an inner face of the thread spool housing 18 on the pillar 12 side. The thread spool 20 may be attached to the spool pin 19 when the spool pin 19 is inserted through an insertion hole (not shown in the drawings) that is formed in the thread spool 20. An upper thread (not shown in the drawings), which extends from the thread spool 20, may be supplied to a needle 7 (refer to FIG. 2) through a thread guide portion that includes a tensioner, a thread take-up spring, a thread take-up lever, and the like, which are not shown in the drawings. The tensioner is provided in the head 14 and adjusts thread tension. The thread take-up lever is driven reciprocally up and down and pulls the thread up. The needle 7 may be mounted in the needle bar 6. The needle bar 6 is driven up and down by a needle bar up-and-down drive mechanism (not shown in the drawings) that is provided in the head 14. The needle bar up-and-down drive mechanism is driven by a drive shaft (not shown in the drawings) that is rotationally driven by a sewing machine motor 79 (refer to FIG. 3).

A sewing start-and-stop switch 21, a reverse stitch switch 22, a needle up-and-down switch 23, a presser foot elevation switch 24, an automatic threading switch 25, and the like are provided at the bottom of the front face of the arm 13. The sewing start-and-stop switch 21 may be used to start and stop the operation of the sewing machine 1, that is, to instruct starting and stopping of sewing. The reverse stitch switch 22 may be used to input an instruction of feeding the work cloth 100 from the rear to the front, which is opposite to the normal feed direction. The needle up-and-down switch 23 may be used to input an instruction of switching between raising and lowering a stop position of the needle bar 6 (refer to FIG. 2). The presser foot elevation switch 24 may be used to instruct raising and lowering a presser foot 47 (refer to FIG. 2). The automatic threading switch 25 may be instruct starting of automatic threading, that is, leading the thread through the thread take-up lever, the tensioner, and the thread take-up spring, and finally threading the needle 7 (refer to FIG. 2). A speed controller 32 is provided in the center of the bottom of the front face of the arm 13. The speed controller 32 may be used to adjust a speed, that is, a rotary speed of the drive shaft, when the needle bar 6 is driven up and down.

Figure 2:
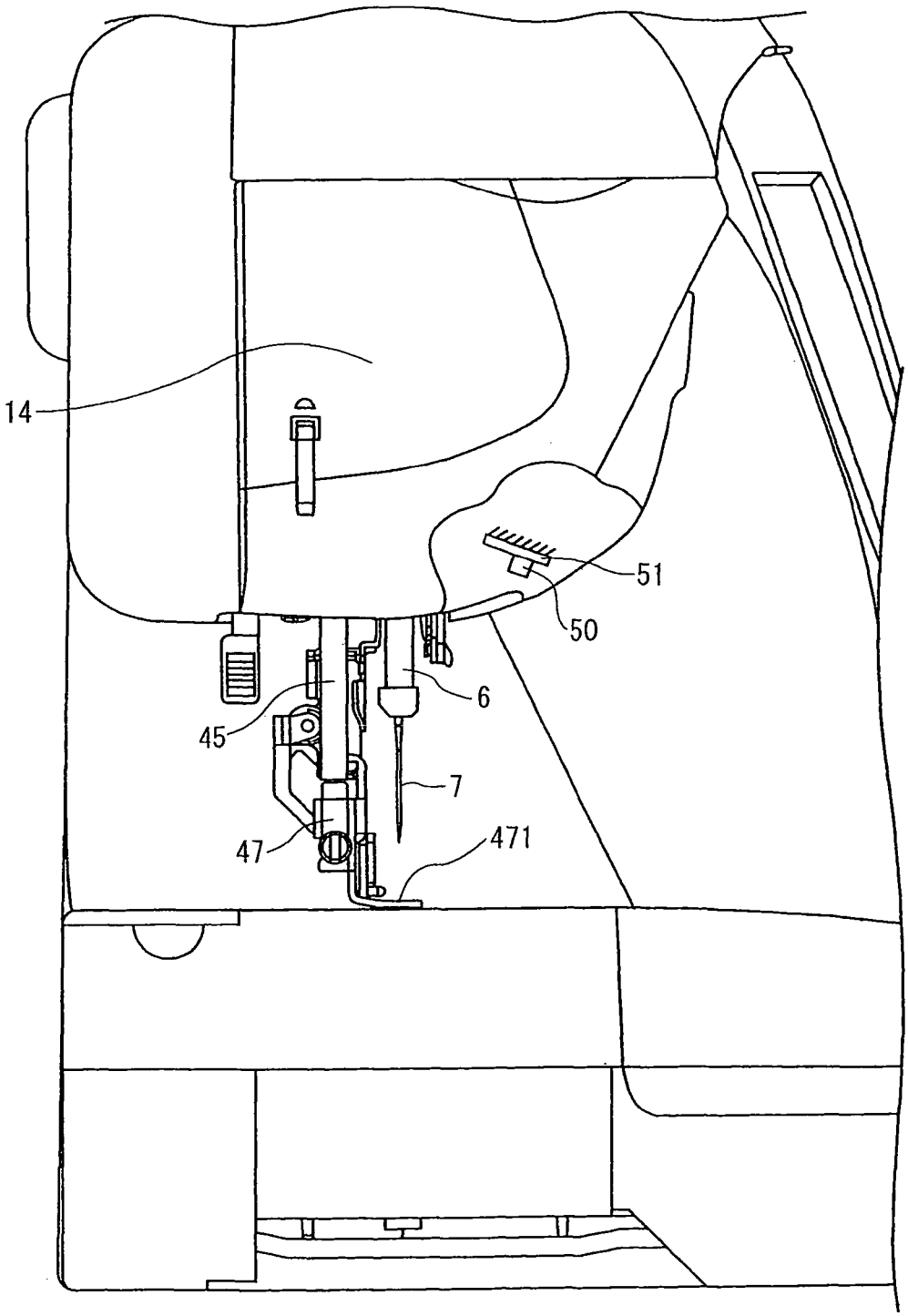
FIG. 2 is a left side view of a main portion of the sewing machine that shows a needle bar, a needle, a presser bar, and a presser foot, as well as a vicinity of the needle bar, the needle, the presser bar, and the presser foot.

The needle bar 6, the needle 7, a presser bar 45, the presser foot 47, and the surrounding area will be explained with reference to FIG. 2. The needle bar 6 and the presser bar 45 are provided on the underside of the head 14. The needle 7 may be attached to the bottom end of the needle bar 6. The presser foot 47, which may hold down the work cloth, may be attached to the bottom end of the presser bar 45. A lower portion 471 of the presser foot 47 is made of a transparent resin such that an image may be captured of the work cloth and stitches underneath the presser foot 47. An image sensor 50 is provided such that the image sensor 50 may capture an image of the area that includes the needle drop point of the needle 7. The needle drop point is the point at which the needle 7 is moved downward by the needle bar up-and-down drive mechanism and pierces the work cloth. The image sensor 50 includes a CMOS (Complementary Metal Oxide Semiconductor) sensor and a control circuit. An image may be captured by the CMOS sensor. In the present embodiment, as shown in FIG. 2, a support frame 51 is attached to a frame (not shown in the drawings) of the sewing machine 1 in the interior of the head 14. The image sensor 50 is fixed to the support frame 51.

Figure 3:
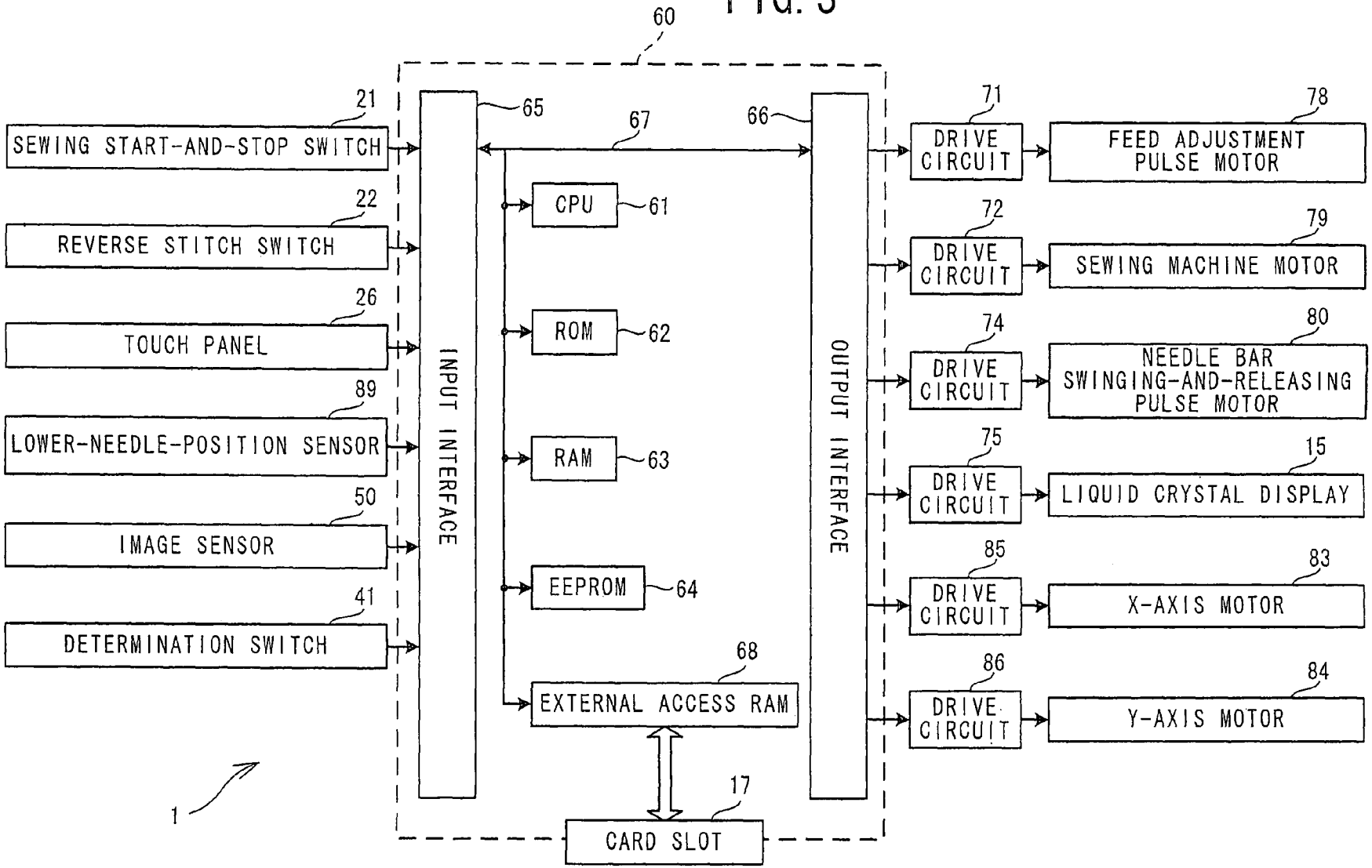
FIG. 3 is a schematic diagram that shows an electrical configuration of the sewing machine.

An electrical configuration of the sewing machine 1 will be explained with reference to FIG. 3. As shown in FIG. 3, a control portion 60 of the sewing machine 1 includes a CPU 61, a ROM 62, a RAM 63, an EEPROM 64, a card slot 17, an external access RAM 68, and an input interface 65, and an output interface 66, which are connected to one another via a bus 67. The sewing start-and-stop switch 21, the reverse stitch switch 22, the touch panel 26, a lower-needle-position sensor 89, the image sensor 50, and a determination switch 41 are connected to the input interface 65. The determination switch 41 may be used to determine the type of an embroidery frame. The needle up-and-down switch 23, the presser foot elevation switch 24, the automatic threading switch 25, and the speed controller 32 are not shown in FIG. 3. Drive circuits 71, 72, 74, 75, 85, and 86 are electrically connected to an output interface 66. The drive circuit 71 drives the feed adjustment pulse motor 78. The drive circuit 72 drives the sewing machine motor 79. The drive circuit 74 drives a needle bar swinging-and-releasing pulse motor 80. The needle bar swinging-and-releasing pulse motor 80 makes the needle bar 6 to swing and operates to release the needle bar 6. The drive circuit 75 drives the liquid crystal display 15. The drive circuits 85 and 86 respectively drive the X-axis motor 83 and the Y-axis motor 84 that move the embroidery frame 34.

The CPU 61 conducts main control over the sewing machine 1 and executes various types of computation and processing in accordance with a control program. The control program is stored in a program data storage area 201 (refer to FIG. 4) in the ROM 62. The ROM 62 is a read-only storage element. The RAM 63 is a storage element that can be read from and written to as desired. The RAM 63 includes various types of storage areas that store computation results from computational processing by the CPU 61 as necessary. The sewing start-and-stop switch 21 is a button switch. The lower-needle-position sensor 89 is a sensor that detects the rotational phase of the drive shaft. The lower-needle-position sensor 89 is set up to output an ON signal if, as the drive shaft rotates, the needle bar 6 lowers from an upper needle position to permit the tip of the needle 7 to reach a position lower than the upper surface of the needle plate (not shown in the drawings).

Figure 4:
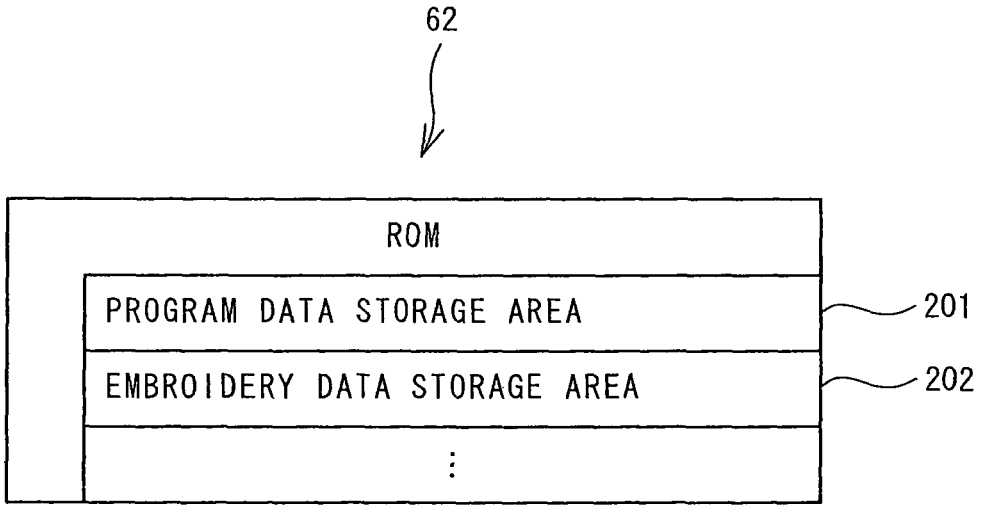
FIG. 4 is a conceptual diagram that shows storage areas of a ROM.

The storage areas which the ROM 62 includes will be explained with reference to FIG. 4. As shown in FIG. 4, the ROM 62 includes the program data storage area 201, an embroidery data storage area 202, and other storage areas. Program data that is required in order for the CPU 61 to perform detection processing of a marker 120 (refer to FIG. 10), sewing processing for an embroidery pattern (refer to FIGS. 11 to 13), and the like is stored in the program data storage area 201.

A plurality of pieces of embroidery data, which are required when an embroidery pattern (an E1 pattern 140 and the like (refer to FIG. 7 and the like)) is sewn on the work cloth 100, are stored in the embroidery data storage area 202. The embroidery data include at least coordinate data (X, Y), which indicates positions of a plurality of needle drop points for an embroidery needle (the needle 7). When the embroidery sewing is performed in the sewing machine 1, the X-axis motor 83 and Y-axis motor 84 are driven based on the coordinate data, so that the embroidery frame 34 is transferred in the X direction and Y direction. An embroidery data table 2021, which will be described below, is stored in the embroidery data storage area 202. The embroidery data is stored in the embroidery data table 2021.

Figure 5:
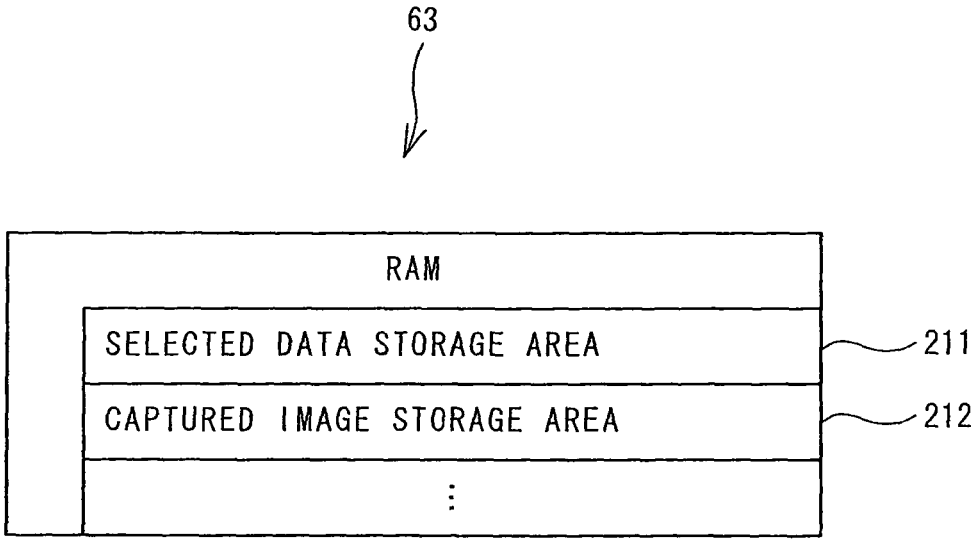
FIG. 5 is a conceptual diagram that shows storage areas of a RAM.

The storage areas which the RAM 63 includes will be explained with reference to FIG. 5. As shown in FIG. 5, the RAM 63 includes a selected data storage area 211, a captured image storage area 212, and other storage areas.

Of the embroidery data that is stored in the embroidery data storage area 202 (refer to FIG. 4) of the ROM 62, the embroidery data for an embroidery pattern that has been selected by a panel operation is stored in the selected data storage area 211. As will be described in detail below, the coordinate data in the embroidery data that is stored in the selected data storage area 211 is changed in a case where at least one of a sewing position, a sewing angle, and the like of the embroidery pattern is changed. A captured image that has been obtained as a result of image capture by the image sensor 50 is stored in the captured image storage area 212.

An example of the embroidery data table 2021 will be explained with reference to FIG. 6. In the present embodiment, an embroidery pattern is divided into a plurality of divided portions (sub-patterns), and the embroidery data includes embroidery data that correspond to each of the sub-patterns of the embroidery pattern. Hereinafter, a sub-pattern that forms at least a portion of the embroidery pattern is referred to as a "first pattern." Embroidery data for the first pattern is referred to as "first embroidery data." A sub-pattern that forms at least a portion of the embroidery pattern and that is adjacent to the first pattern is referred to as a "second pattern." Embroidery data for the second pattern is referred to as "second embroidery data." Hereinafter, an example will be explained in which the embroidery pattern is divided into two sub-patterns (the first pattern and the second pattern).

The embroidery pattern is divided into the sub-patterns and the embroidery data for each of the sub-patterns of embroidery pattern is stored, so that the embroidery pattern may be sewn on the work cloth 100 even in a case where the embroidery pattern is larger than the area within the embroidery frame 34. That is because the first pattern and the second pattern may be separately sewn so that the embroidery pattern may be sewn in several batches.

As shown in FIG. 6, a type of an embroidery pattern, first embroidery data for a first pattern that forms a portion of the embroidery pattern, and second embroidery data for a second pattern that forms another portion of the embroidery pattern are stored in association with one another in the embroidery data table 2021. In the example that is shown in FIG. 6, first E1 data that is the first embroidery data and second E1 data that is the second embroidery data are stored in association with an embroidery pattern E1. In the same manner, first E2 data and second E2 data are stored in association with an embroidery pattern E2.

Figure 7:
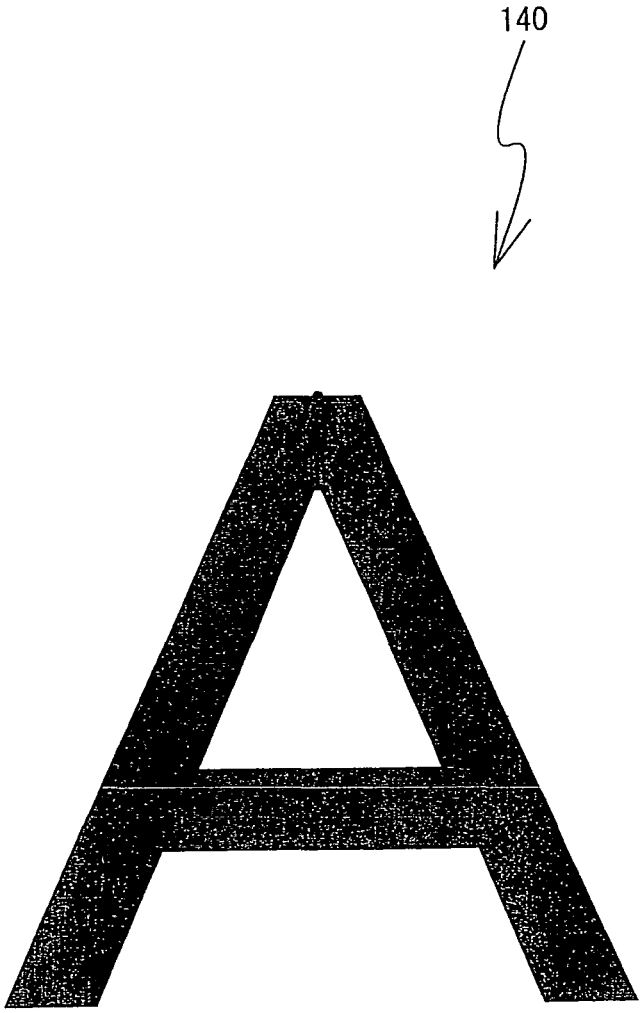
FIG. 7 is a figure that shows an E1 pattern.

The embroidery pattern E1 (hereinafter referred to as an "E1 pattern 140") that is stored in the embroidery data table 2021 will be explained in detail with reference to FIGS. 7 to 9. As shown in FIG. 7, the E1 pattern 140 is an embroidery pattern that has the shape of a letter "A" in the Gothic font. The E1 pattern 140 includes a first E1 pattern 142 (refer to FIG. 8) that is the first pattern and a second E1 pattern 143 (refer to FIG. 9) that is the second pattern.

Figure 8:
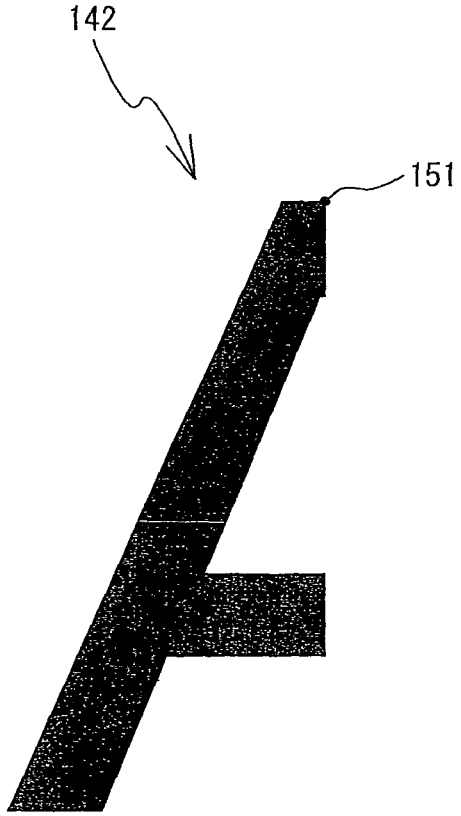
FIG. 8 is a figure that shows a first E1 pattern.
Figure 9:
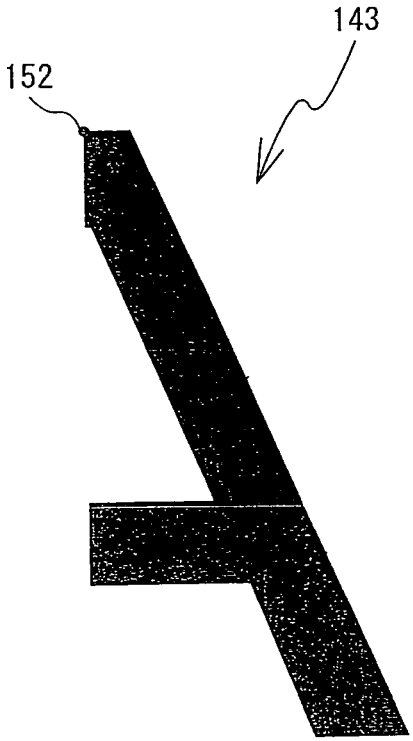
FIG. 9 is a figure that shows a second E1 pattern.

As shown in FIG. 8, the first E1 pattern 142 is an embroidery pattern that has the shape of the left half of the letter "A" in the E1 pattern 140 (refer to FIG. 7). The first E1 pattern 142 is sewn on the work cloth 100 by performing of the sewing processing based on the first E1 data. As shown in FIG. 9, the second E1 pattern 143 is an embroidery pattern that has the shape of the right half of the letter "A" in the E1 pattern 140 (refer to FIG. 7). The second E1 pattern 143 is sewn on the work cloth 100 by performing of the sewing processing based on the second E1 data. The first E1 pattern 142 and the second E1 pattern 143 are sewn such that the second E1 pattern 143 abuts the right side of the first E1 pattern 142, so that the E1 pattern 140 that is shown in FIG. 7 is formed in the work cloth 100.

Hereinafter, the first E1 data includes (Ax, Ay) as coordinate data. The second E1 data includes (Bx, By) as coordinate data. As shown in FIG. 8, a point 151 at the vertex at the top of the shape of the left half of the letter "A" of the first E1 pattern 142 is defined as an origin point (0, 0). As shown in FIG. 9, a point 152 at the vertex at the top of the shape of the right half of the letter "A" of the second E1 pattern 143 is also defined as the origin point (0, 0). The points 151 and 152 indicate the same point in the E1 pattern 140. The origin point is not limited to the vertex at the top of the shape of a pattern. The origin point may be any point other than the vertex at the top of the shape of the pattern.

In the present embodiment, the sewing work for the E1 pattern 140 is performed as described below. Based on the first E1 data, the first E1 pattern 142 is sewn on the work cloth 100 that is held by the embroidery frame 34. In order for the second E1 pattern 143 to be sewn such that the second E1 pattern 143 is adjacent to the right side of the first E1 pattern 142 that has already been sewn, the work cloth 100 is repositioned. After the work cloth 100 is repositioned, the second E1 pattern 143 is sewn on the work cloth 100 based on the second E1 data.

Figure 10:
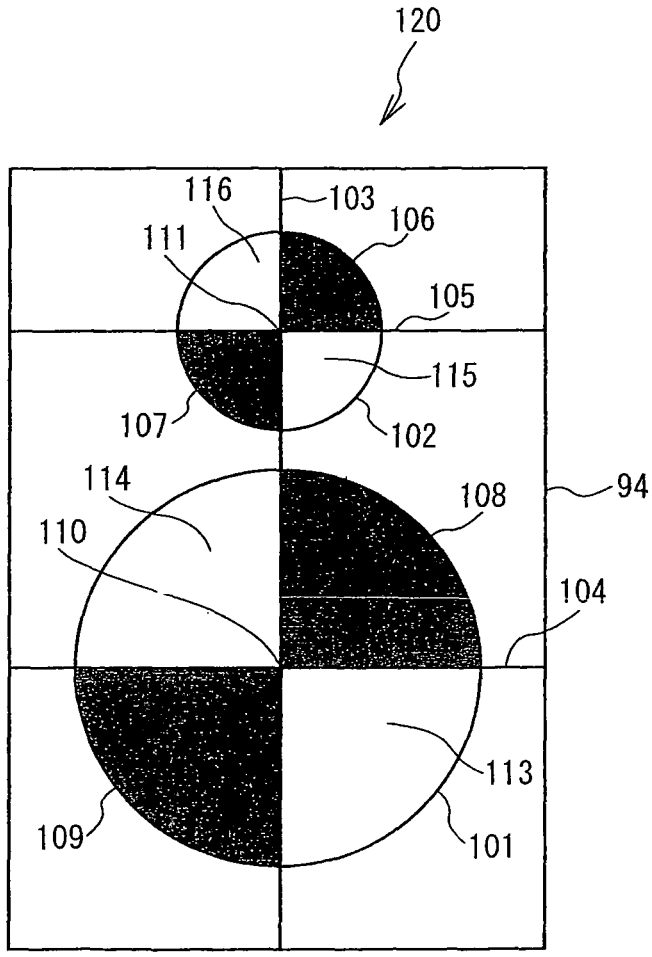
FIG. 10 is a figure that shows a shape of a marker.

In the present embodiment, the marker 120 is used (refer to FIG. 10, details will be described below). The marker 120 may be affixed onto the work cloth 100. In a case where the work cloth 100 has been repositioned, the marker 120 is used for computing the distance that the work cloth 100 has been moved in relation to the embroidery frame 34. The second E1 data is converted based on the computed distance. Because sewing of the second E1 pattern 143 is performed based on the converted second E1 data, the second E1 pattern 143 is sewn such that the second E1 pattern 143 abuts the first E1 pattern 142 without any misalignment.

The marker 120 will be explained with reference to FIG. 10. The marker 120 that is shown in FIG. 10 includes a base material sheet 94 that is transparent and that has a thin sheet shape. The size of the base material sheet 94 may be approximately three centimeters long and approximately two centimeters wide, for example. The shape of the base material sheet 94 may be rectangular, for example. The size and the shape of the base material sheet 94 are not limited to the size and shape described above. A first circle 101 and a second circle 102 are drawn on the upper surface of the base material sheet 94. The second circle 102 is disposed above the first circle 101. The diameter of the second circle 102 is smaller than the diameter of the first circle 101. Line segments 103 to 105 are also disposed on the base material sheet 94. The line segment 103 extends in the up-down direction and passes through a center 110 of the first circle 101 and a center 111 of the second circle 102. The line segment 104 is orthogonal to the line segment 103 and passes through the center 110 of the first circle 101. The line segment 105 is orthogonal to the line segment 103 and passes through the center 111 of the second circle 102. The line segments 103 to 105 are each drawn such that the line segments 103 to 105 extend to the outer edges of the base material sheet 94.

Of the four areas that are bounded by the circumference of the first circle 101, the line segment 103 and the line segment 104, an upper right area 108 and a lower left area 109 are filled in with black, and a lower right area 113 and an upper left area 114 are filled in with white. Of the four areas that are bounded by the second circle 102, the line segment 103 and the line segment 105, an upper right area 106 and a lower left area 107 are filled in with black, and a lower right area 115 and an upper left area 116 are filled in with white. All other portions of the marker 120 are transparent.

The colors with which the four areas of the first circle 101 and the four areas of the second circle 102 are filled in are not limited to being black and white. Other colors may be combined such that a contrast between the areas is clearly visible. Furthermore, in a case where the work cloth 100 is a fabric that is one of white and a color that is close to white, for example, the upper right areas 106, 108 and the lower left areas 107, 109 may be filled in with black, and the lower right areas 113, 115 and the upper left areas 114, 116 may be transparent. Conversely, in a case where the work cloth 100 is a fabric that is one of black and a color that is close to black, the lower right areas 113, 115 and the upper left areas 114, 116 may be filled in with white, and the upper right areas 106, 108 and the lower left areas 107, 109 may be transparent. Thus a marker may be used that has a color suitable for the color of the work cloth 100.

The bottom surface of the base material sheet 94 is coated with a transparent adhesive. It is therefore possible to affix the base material sheet 94 onto the work cloth 100. Ordinarily, the base material sheet 94 is affixed to a release paper (not shown in the drawings). The user may use the base material sheet 94 by peeling the base material sheet 94 off the release paper.

The sewing processing that is performed by the CPU 61 of the sewing machine 1 will be explained with reference to FIGS. 11 to 13. The sewing processing is started by the CPU 61 in a case where a panel operation for starting the embroidery sewing has been performed.

Figure 11:
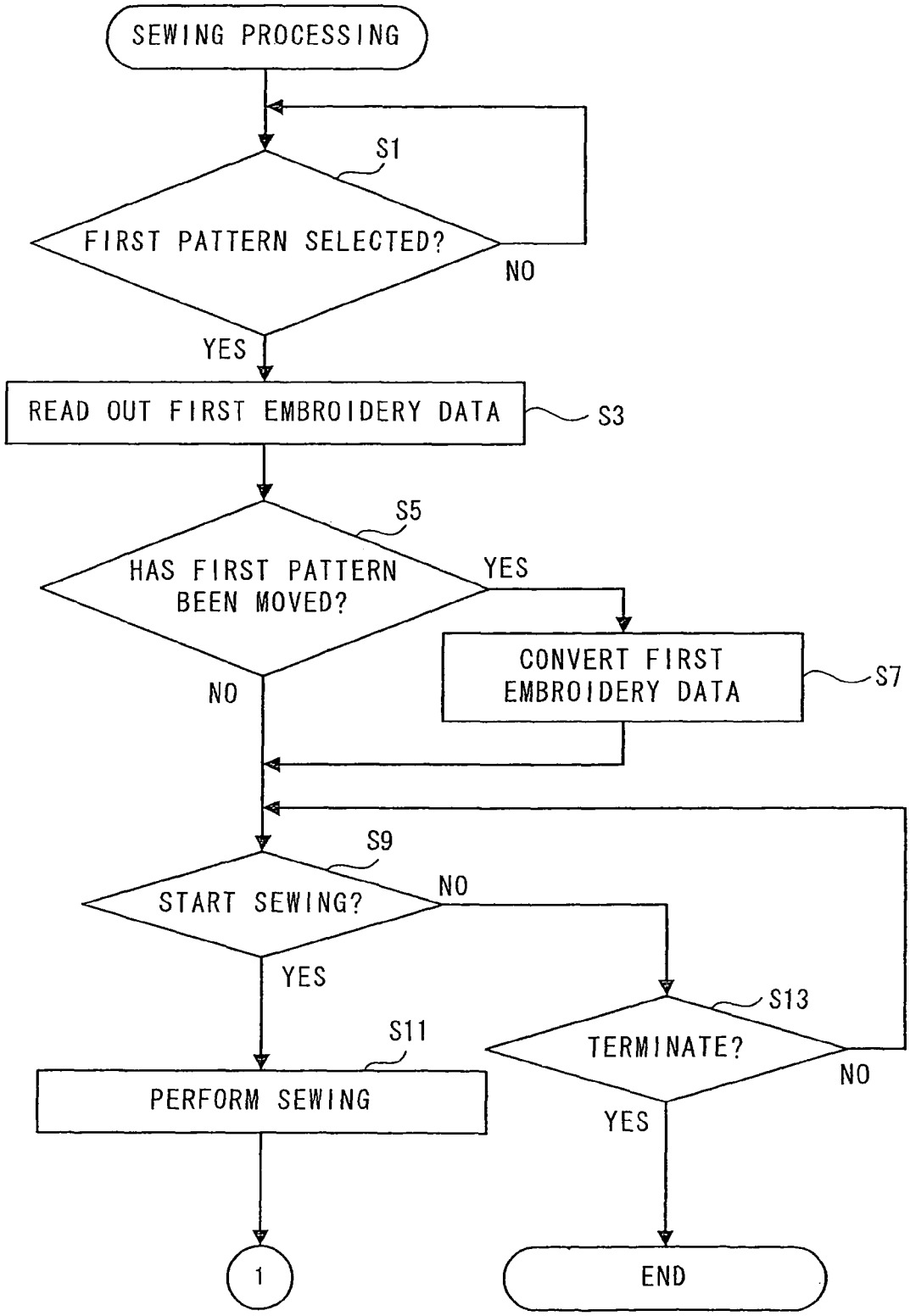
FIG. 11 is a first part of a flowchart that shows sewing processing.

As shown in FIG. 11, when the sewing processing is started, a determination is made as to whether a panel operation for selecting a first pattern has been performed (Step S1). If the panel operation for selecting the first pattern has not been performed (NO at Step S1), the processing returns to Step S1. Then the panel operation for selecting the first pattern is continually monitored. If the first pattern has been selected (YES at Step S1), first embroidery data that is embroidery data for the selected first pattern is read out from the embroidery data table 2021 that is stored in the ROM 62. In a case where the first E1 pattern 142 has been selected as the first pattern, the first E1 data is read out from the embroidery data table 2021 as the first embroidery data (Step S3). The first E1 data that has been read out is stored in the selected data storage area 211 of the RAM 63.

A determination is made as to whether at least one of the sewing position and the sewing angle for the selected first pattern to be sewn on the work cloth 100 has been changed from their default states (Step S5). If a panel operation for changing at least one of the sewing position and the sewing angle has not been performed (NO at Step S5), the processing advances to Step S9 without any particular processing performed. If the panel operation for changing at least one of the sewing position and the sewing angle has been performed (YES at Step S5), the first embroidery data that is stored in the selected data storage area 211 of the RAM 63 is converted based on the panel operation (Step S7). The converted coordinate data are stored in the selected data storage area 211 as the coordinate data for the first embroidery data. Then the processing advances to Step S9.

The conversion of the coordinate data at Step S7 based on the panel operation may be performed by the method that is described below, for example. The panel operation causes the point 151 of the first E1 pattern 142 to be moved by an distance (Ox, Oy), after which the first E1 pattern 142 is rotated around the point 151 by an angle $\theta_1$. Assuming that the coordinate data for the moved and rotated first E1 data is indicated as (Ax', Ay'), the coordinate data is obtained as follows.

$$Ax'=(Ax+Ox)\cos\theta_1-(Ay+Oy)\sin\theta_1$$

$$Ay'=(Ax+Ox)\sin\theta_1+(Ay+Oy)\cos\theta_1$$

The obtained coordinate data (Ax', Ay') is stored in the selected data storage area 211 of the RAM 63 as the coordinate data for the first E1 data.

At Step S9, a determination is made as to whether the sewing start-and-stop switch 21 has been pressed (Step S9). If the sewing start-and-stop switch 21 has not been pressed (NO at Step S9), a determination is made as to whether a panel operation for terminating the sewing processing has been performed (Step S13). If the panel operation for terminating the sewing processing has been performed (YES at Step S13), the sewing processing is terminated. If the panel operation for terminating the sewing processing has not been performed (NO at Step S13), the processing returns to Step S9. Then it is continually determined whether the sewing start-and-stop switch 21 has been pressed.

If the sewing start-and-stop switch 21 has been pressed to start the work of sewing (YES at Step S9), processing for sewing the first pattern on the work cloth 100 is performed based on the first embroidery data that is stored in the selected data storage area 211 (Step S11). Specifically, the X-axis motor 83 and the Y-axis motor 84 are driven based on the coordinate data that is included in the first embroidery data. The needle bar 6 (refer to FIG. 2) and the shuttle mechanism (not shown in the drawings) are also driven as the embroidery frame 34 is transferred in the X direction and the Y direction. Thus the first pattern is sewn on the work cloth 100 that is held by the embroidery frame 34. In a case where the first embroidery data has been converted at Step S7, the work of sewing the first pattern is performed based on the converted first embroidery data. Thus the first pattern is sewn on the work cloth 100 that is held by the embroidery frame 34.

Figure 14:
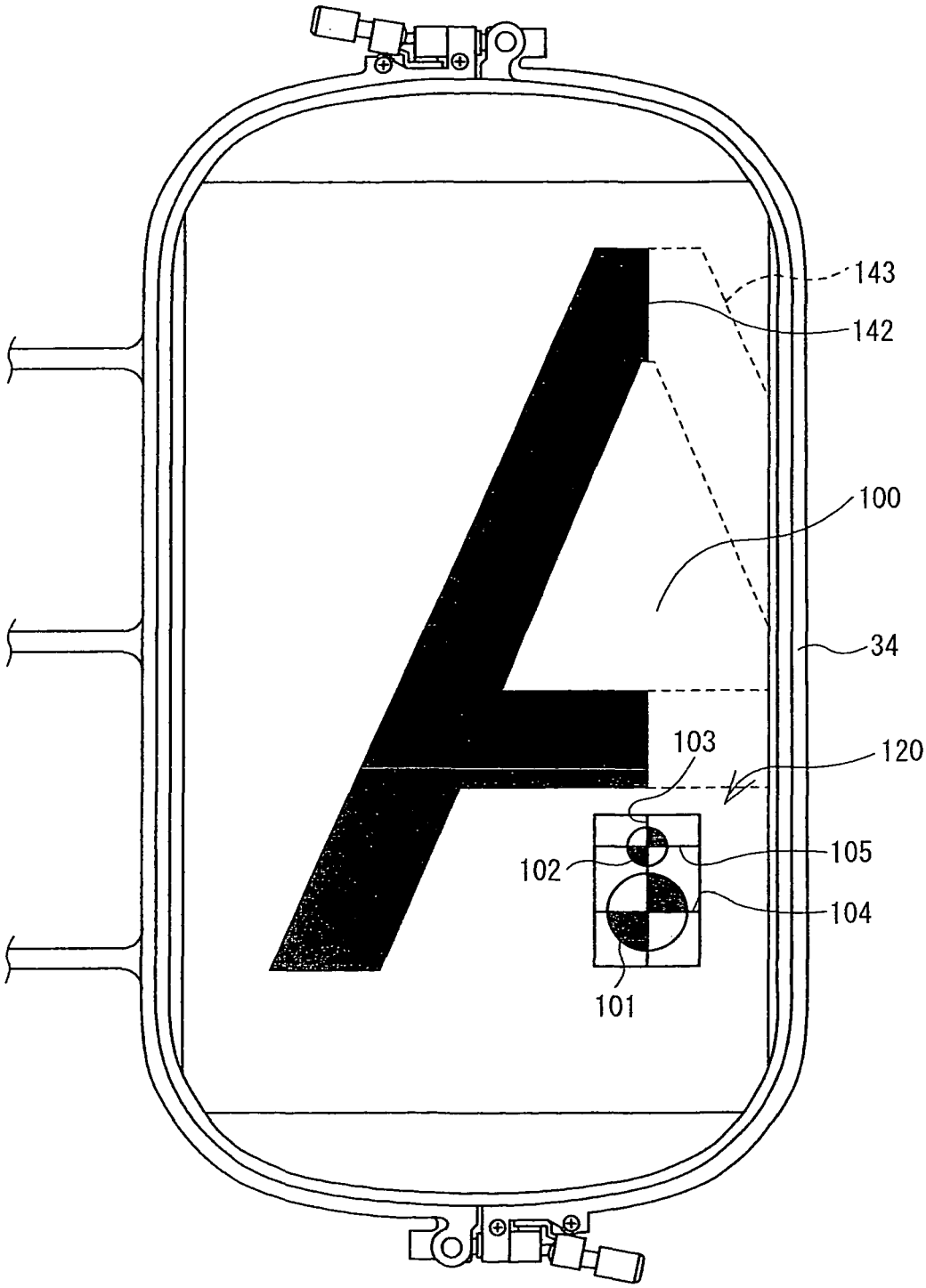
FIG. 14 is a figure that shows an example of a state in which the first E1 pattern has been sewn in a work cloth.

After the work of sewing the first pattern has been completed, the user may stick the marker 120 onto the work cloth 100 that is held by the embroidery frame 34. The work cloth 100 onto which the marker 120 has been affixed will be explained with reference to FIG. 14. As shown in FIG. 14, the first E1 pattern 142 that has the shape of the left half of the letter "A" has been sewn on the work cloth 100. The marker 120 may be affixed onto a portion of the work cloth 100 that is close to the lower right corner of the embroidery frame 34. The marker 120 may be affixed onto the work cloth 100 such that the line segment 103 is substantially parallel to the Y direction (the front-rear direction) in which the embroidery frame 34 is moved. In such a case, the second circle 102 is disposed along the line segment 103 in the rear side of the sewing machine 1 (in the upper side of the page in FIG. 14), and the first circle 101 is disposed along the line segment 103 in the front side (in the lower side of the page in FIG. 14). In FIG. 14, the broken lines indicate the planned sewing position for the second E1 pattern 143 that will be sewn next. In FIG. 14, the size of the work cloth 100 is actually larger than the size of the embroidery frame 34, and the work cloth 100 extends beyond the embroidery frame 34. The portion of the work cloth 100 that extends beyond the embroidery frame 34 has been omitted from the drawing.

In order for the second E1 pattern 143 to be sewn such that the second E1 pattern 143 abuts the right side of the first E1 pattern 142, the area of the work cloth 100 in the right side of the sewn first E1 pattern 142 needs to be positioned substantially in the center of the embroidery frame 34. Therefore, the work cloth 100 needs to be moved to the left and repositioned in the embroidery frame 34 before the work of embroidering the second E1 pattern 143 is performed. In the present embodiment, images of the marker 120 are captured by the image sensor 50 before and after the work cloth 100 is repositioned. The marker 120 is affixed onto the work cloth 100 in a position that is inside the embroidery frame 34 and close to the right side of the embroidery frame 34. This allows the marker 120 to still be within the embroidery frame 34 after the work cloth 100 has been moved to the left. It is therefore possible for an image of the marker 120 to be captured by the image sensor 50.

Figure 12:
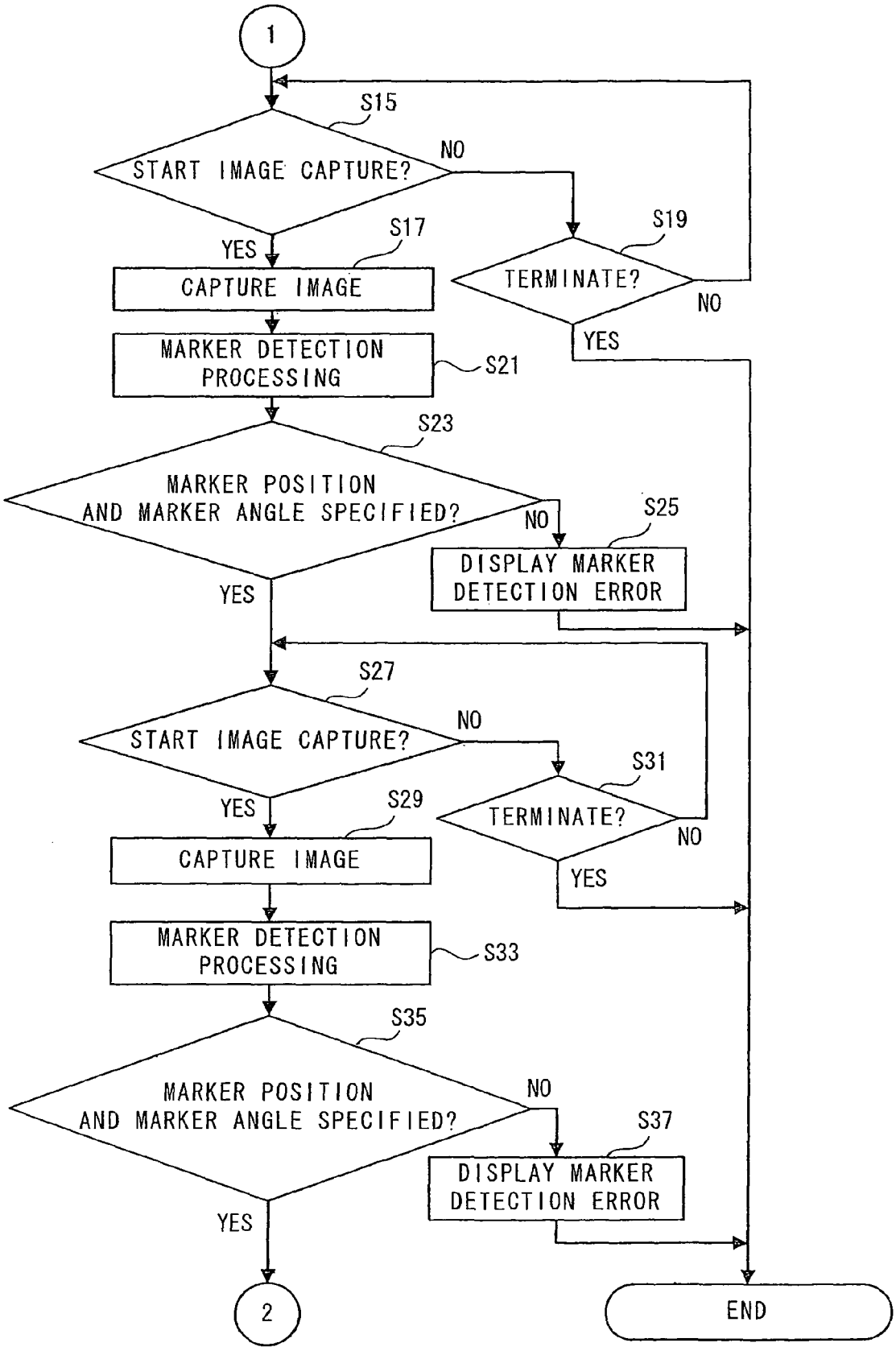
FIG. 12 is a second part of the flowchart that shows the sewing processing.

After the marker 120 has been affixed onto the work cloth 100 by the user, a determination is made as to whether a panel operation for starting the image capture of the work cloth 100 by the image sensor 50 has been performed, as shown in FIG. 12 (Step S15). If the panel operation for starting the image capture has not been performed (NO at Step S15), a determination is made as to whether a panel operation for terminating the sewing processing has been performed (Step S19). If the panel operation for terminating the sewing processing has been performed (YES at Step S19), the sewing processing is terminated. If the panel operation for terminating the sewing processing has not been performed (NO at Step S19), the processing returns to Step S15. Then it is continuously determined whether the panel operation for staring the image capture has been performed.

If the panel operation for starting the image capture has been performed (YES at Step S15), the image of the work cloth 100 is captured by the image sensor 50 (Step S17). The captured image is stored in the captured image storage area 212 of the RAM 63. Next, processing is performed that detects the marker 120 that has been affixed onto the work cloth 100 based on the stored captured image (Step S21). An example of the detection processing will be explained below.

Figure 15:
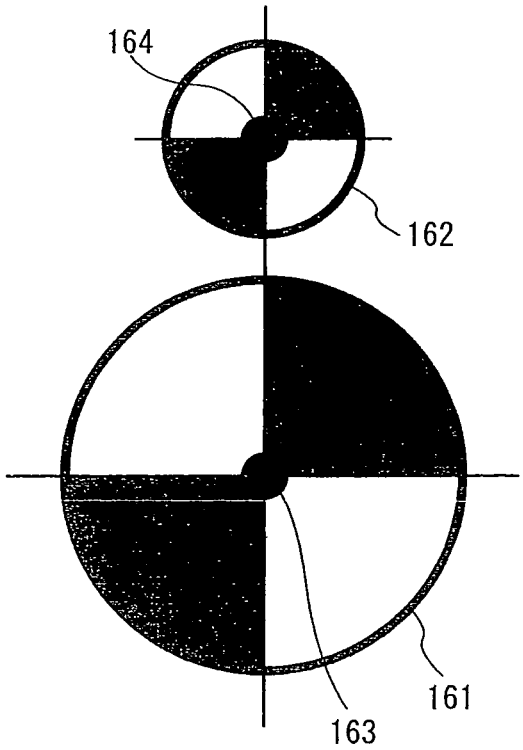
FIG. 15 is an explanatory figure that shows processing in which the marker is detected based on captured image data.

A method for detecting the marker 120 based on the captured image will be explained with reference to FIGS. 15 and 16. First, two-dimensional coordinates in an image coordinate system are computed for the first circle 101 and the second circle 102 of the marker 120 (refer to FIG. 10). The image coordinate system is a coordinate system for the image that has been captured by the image sensor 50. The two-dimensional coordinates in the image coordinate system are computed based on a position in the image. Specifically, circumferences of a circle 161 and a circle 162 are identified in the captured image, as shown in FIG. 15, for example, by Hough transform processing, which is a known technique. The coordinates of a center 163 of the circle 161 and a center 164 of the circle 162, and radii of the circle 161 and the circle 162 are computed. At this point, a circle that is included in a pattern or the like of the work cloth 100 itself may be identified in addition to the first circle 101 and the second circle 102 of the marker 120. Hereinafter, coordinates that are computed for a center of a circle are indicated as (a, b) (for example, (a1, b1), (a2, b2), (a3, b3), and the like), and a radius that is computed for a circle is indicated as r (for example, r1, r2, r3, and the like).

Figure 16:
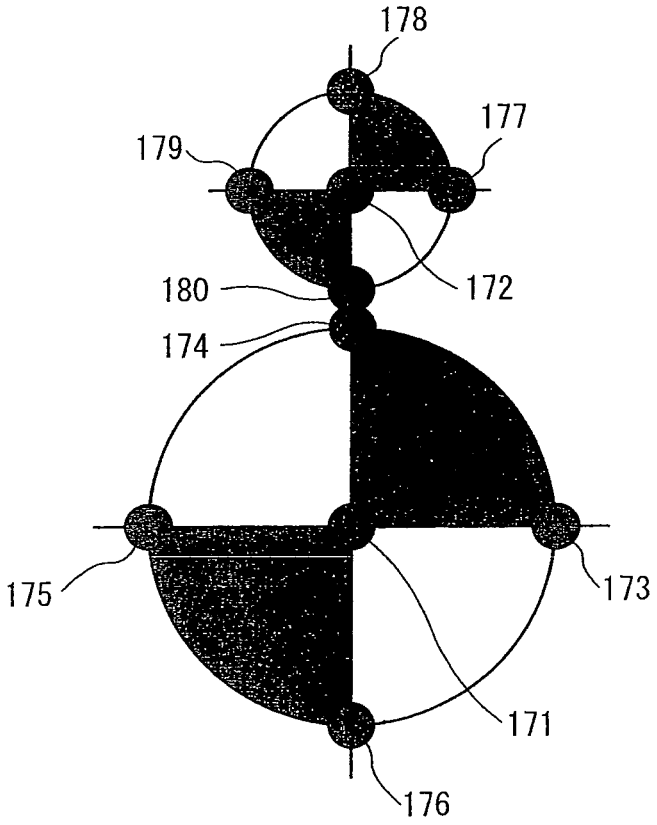
FIG. 16 is an explanatory figure that shows processing in which the marker is detected based on the captured image data.

A Harris operator, for example, which is a known technique, is used to compute coordinates 171 to 180 of corners, from the captured image, as shown in FIG. 16. Here, the corner refers to an intersection point at which a plurality of edges (portions that are each formed of a line, such as a contour) intersect with each other, among portions such as borderlines where brightness changes suddenly. Hereinafter, the computed coordinates of the corners are indicated as (s, t) (for example, (s1, t1, (s2, t2), (s3, t3), and the like).

The coordinates (a, b) of the center of the circle and the radius r of the circle, which are obtained by the Hough transform processing, are compared with the coordinates (s, t) of the corner, which are obtained by the Harris operator. In a case where coordinates (s, t) correspond to coordinates (a, b) and where coordinates (s, t) correspond to coordinates of a position whose distance from the coordinates (a, b) is equal to a radius r, it is determined that the coordinates (s, t) that correspond to the coordinates (a, b) are the coordinates of the center of a circle in the marker 120 that is shown in FIG. 10, and it is determined that the coordinates (s, t) that correspond to the coordinates of the position whose distance from the coordinates (a, b) is equal to the radius r are coordinates of an intersection point of a circumference of the circle and a line segment. Accordingly, it is determined that the coordinates (s, t) that correspond to the coordinates (a, b) are the coordinates of the center of one of the first circle 101 and the second circle 102. Further, it is determined that the coordinates (s, t) that correspond to the coordinates of the position whose distance from the coordinates (a, b) is equal to the radius r are either: (i) the coordinates of the intersection point of the first circle 101 and one of the line segments 103 and 104; or (ii) the coordinates of the intersection point of the second circle 102 and one of the line segments 103 and 105. Of the coordinates (s, t) that are the coordinates of the center of one of the first circle 101 and the second circle 102, the coordinates that correspond to the center of the circle for which the value of the radius r that has been obtained by the Hough transform processing is greater are identified as the coordinates (i, j) of the center of the first circle 101. On the other hand, the coordinates that correspond to the center of the circle for which the value of the radius r is smaller are identified as the coordinates (I, J) of the center of the second circle 102. The coordinates of the centers of the first circle 101 and the second circle 102 in the marker 120 that is affixed onto the work cloth 100 are thus detected by performing the image processing that is described above.

Next, three-dimensional coordinate conversion processing is performed for the coordinates of the centers of the first circle 101 and the second circle 102 that have been computed. In the three-dimensional coordinate conversion processing, two-dimensional coordinates of the image coordinate system are converted into three-dimensional coordinates of an embroidery coordinate system (a world coordinate system). The embroidery coordinate system is the coordinate system of the X-axis motor 83 and the Y-axis motor 84, which move the carriage (not shown in the drawings). In the present embodiment, the embroidery coordinate system previously corresponds to the actual three-dimensional coordinate system (the world coordinate system). The three-dimensional coordinate conversion processing may be performed using a known method. Coordinates (P1, Q1, R1) of the center of the first circle 101 and coordinates (P2, Q2, R2) of the center of the second circle 102 are computed by performing the three-dimensional coordinate conversion processing.

A marker position and a marker angle of the marker 120 are computed. The marker position is defined as coordinates of the center of the first circle 101 in relation to an origin point (the needle drop point). The marker angle is defined as the angle of a vector from the center of the first circle 101 to the center of the second circle 102 in relation to the X direction. The marker position of the detected marker 120 is specified as (P1, Q1, R1) based on the coordinates of the center of the identified first circle 101. In the present embodiment, the Z axis coordinate of a point on the work cloth 100 is defined as zero (a fixed value). Therefore, based on the coordinates (P1, Q1, R1) of the center of the identified first circle 101 and the coordinates (P2, Q2, R2) of the center of the second circle 102, a marker angle $\theta_2$ of the detected marker 120 is obtained as $\theta_2=\tan^{-1}((Q1-Q2)/(P1-P2))$.

As shown in FIG. 12, if the marker position and the marker angle have not been specified for failure of the detection processing at Step S21 (NO at Step S23), a screen for indicating that the marker 120 has not been detected is displayed on the liquid crystal display 15 (refer to FIG. 1) (Step S25). The sewing processing is then terminated.

If the detection processing at Step S21 has been successfully performed and the marker position and the marker angle have been specified (YES at Step S23), in order for the second pattern to be sewn adjacent to the first pattern, the work cloth 100 may be temporarily removed from the embroidery frame 34. Then the work cloth 100 may be moved such that the area of the work cloth 100 where the second pattern will be sewn (the area to the right of the portion where the first E1 pattern 142 has been sewn) is roughly in the center of the embroidery frame 34, and the work cloth 100 may be once again held by the embroidery frame 34.

Figure 17:
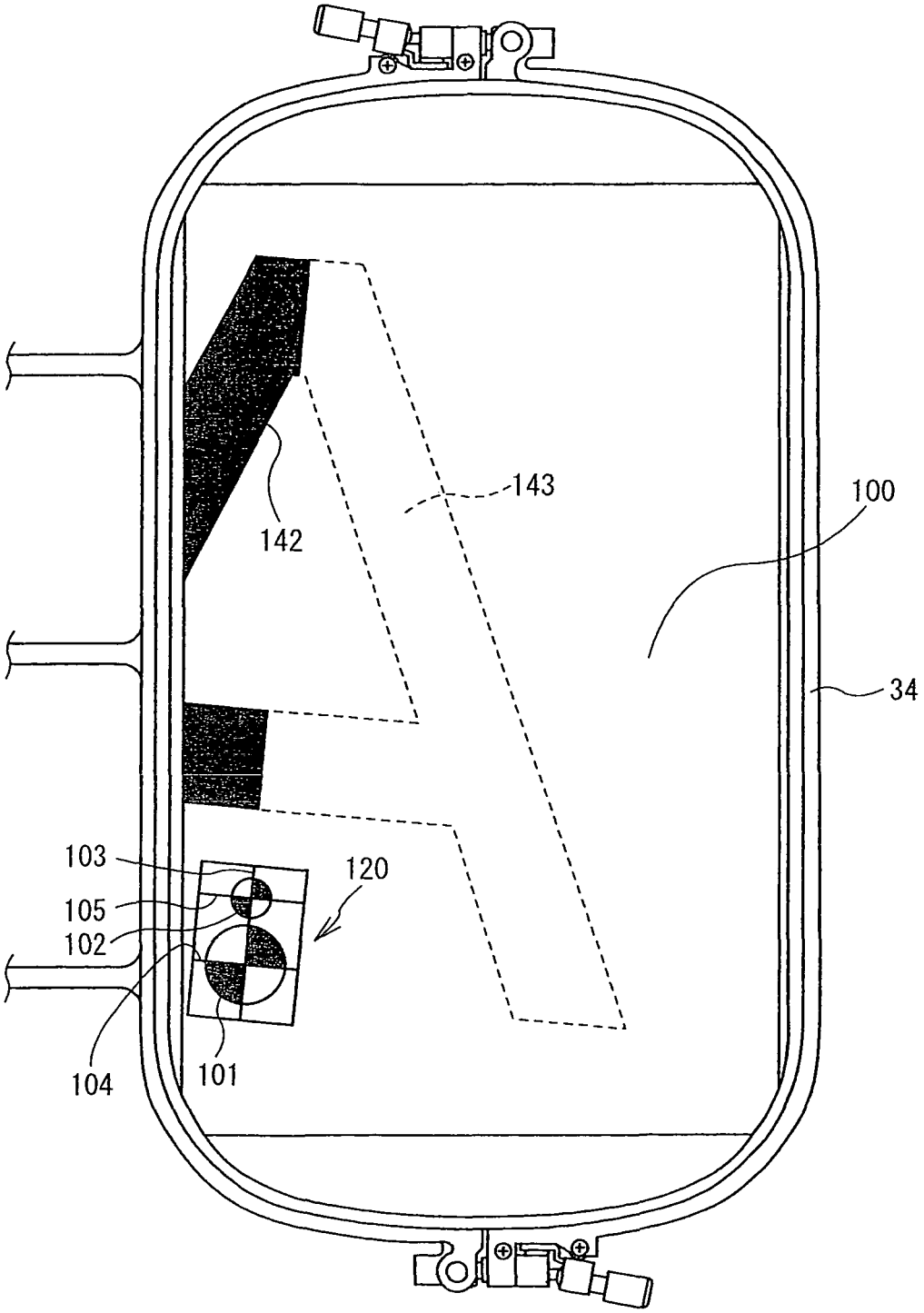
FIG. 17 is a figure that shows an example of a state in which the first E1 pattern has been sewn in the work cloth.

The state in which the work cloth 100 has been repositioned will be explained with reference to FIG. 17. As shown in FIG. 17, the work cloth 100 is in a state in which the work cloth has been moved to the left by a distance that is almost equal to the length of the embroidery frame 34 in the right-left direction. The right edge portion of the first E1 pattern 142 that has the shape of the left half of the letter "A" is disposed in an area of the work cloth 100 that is close to the left edge of the embroidery frame 34. The marker 120 is affixed onto a portion of the work cloth 100 that is close to the lower left corner of the embroidery frame 34. The line segment 103 of the marker 120 is in a state in which the rear end (the upper side of the page in FIG. 17) of the line segment 103 in the Y direction is inclined slightly to the right. In other words, the work cloth 100 is held by the embroidery frame 34 in a state in which the rear side of the work cloth 100 in the Y direction is inclined slightly to the right, compared to the state before the work cloth 100 is repositioned. In FIG. 17, the broken lines indicate the planned sewing position for the second E1 pattern 143 that will be sewn next. In FIG. 17, in the same manner as in FIG. 14, the portion of the work cloth 100 that extends beyond the embroidery frame 34 has been omitted from the drawing.

As shown in FIG. 12, if the marker position and the marker angle have been specified (YES at Step S23), a determination is made as to whether a panel operation for starting the image capture of the work cloth 100 by the image sensor 50 has been performed (Step S27). If the panel operation for starting the image capture has not been performed (NO at Step S27), a determination is made as to whether the panel operation for terminating the sewing processing has been performed (Step S31). If the panel operation for terminating the sewing processing has been performed (YES at Step S31), the sewing processing is terminated. If the panel operation for terminating the sewing processing has not been performed (NO at Step S31), the processing returns to Step S27. Then it is continuously determined whether the panel operation for starting the image capture has been performed.

If the panel operation for starting the image capture has been performed (YES at Step S27), the image of the work cloth 100 is captured by the image sensor 50 (Step S29). The captured image is stored in the captured image storage area 212 of the RAM 63. Next, the processing is performed that detects the marker 120 that has been affixed onto the work cloth 100 based on the stored captured image (Step S33). The same method as the method that is used at Step S21, for example, may be used for the detection processing. The coordinates of the centers of the first circle 101 and the second circle 102 that are identified by the detection processing are indicated as (L1, M1, N1) and (L2, M2, N2), respectively.

In a case where the detection processing has been performed at Step S33, the marker position and the marker angle of the marker 120 are computed. A marker position of the detected marker 120 is specified as (L1, M1, N1) based on the coordinates of the center of the identified first circle 101. Based on the coordinates (L1, M1, N1) of the center of the identified first circle 101 and the coordinates (L2, M2, N2) of the center of the second circle 102, a marker angle $\theta_3$ of the detected marker 120 is obtained as $\theta_3=\tan^{-1}((M2-M1)/(L2-L1))$.

If the marker position and the marker angle of the marker 120 have not been specified for failure of the detection processing at Step S33 (NO at Step S35), the screen for indicating that the marker 120 has not been detected is displayed on the liquid crystal display 15 (refer to FIG. 1) (Step S37). The sewing processing is then terminated.

Figure 13:
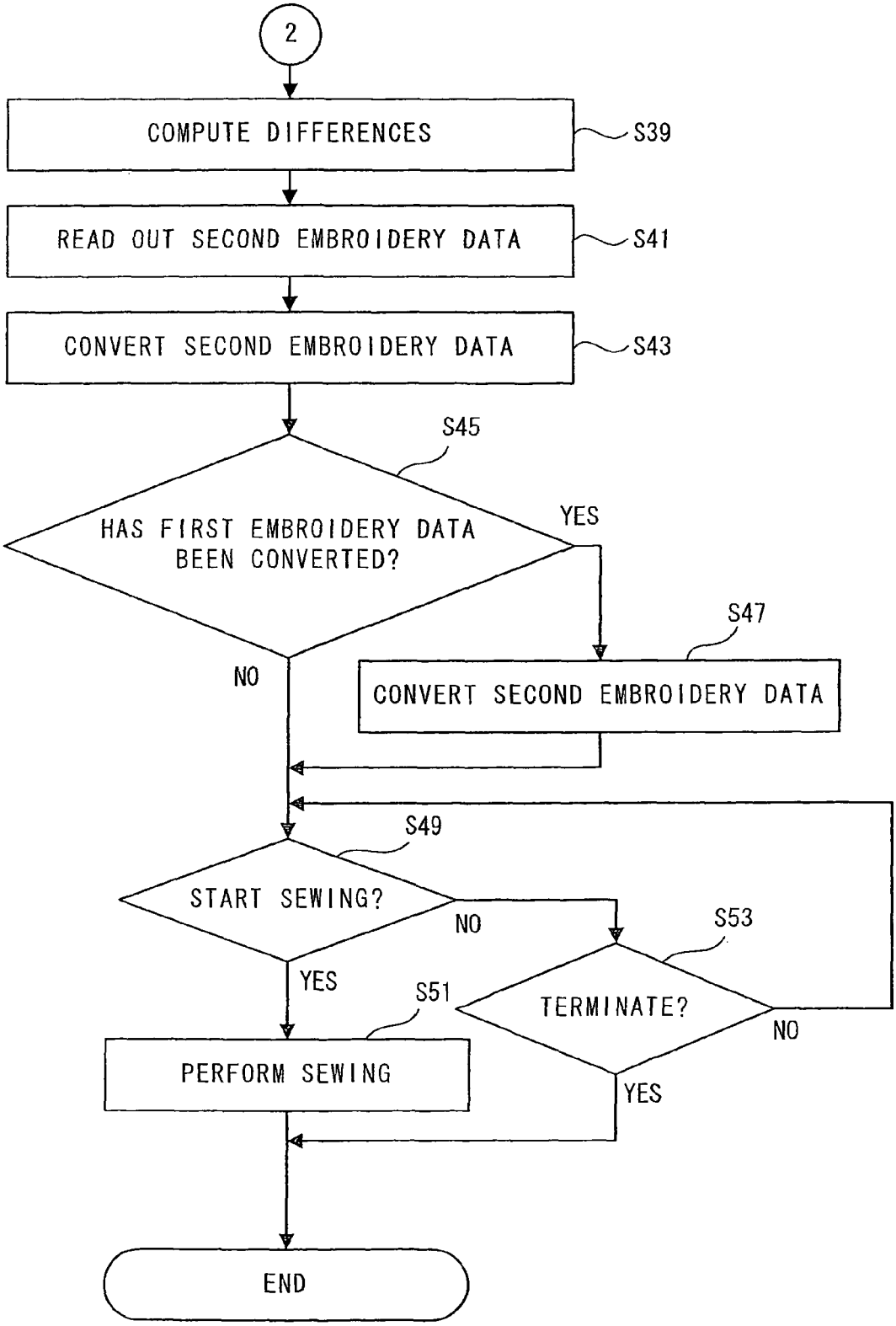
FIG. 13 is a third part of the flowchart that shows the sewing processing.

If the detection processing at Step S33 has been successfully performed and the marker position and the marker angle of the marker 120 have been specified (YES at Step S35), the difference between the marker positions that have been specified at Steps S21 and S33 and the difference between the marker angles that have been specified at Steps S21 and S33 are computed, as shown in FIG. 13 (Step S39). The differences correspond to the distance that the work cloth 100 has been moved, and may be computed as described below, for example.

The amount of change in the marker position in the X direction is indicated as Px, and the amount of change in the marker position in the Y direction is indicated as Py. In this case, based on the marker positions before and after the work cloth 100 is repositioned, the amounts of changes Px and Py are obtained as follows.

$Px=(L1-P1)$ $Py=(M1-Q1)$

In the present embodiment, the Z coordinate of a point on the work cloth 100 is defined as zero (a fixed value), so an amount of change in the Z direction may not be computed.

The amount of change in the marker angle is indicated as $\theta_4$. In this case, based on the marker angles before and after the work cloth 100 is repositioned, the amount of change $\theta_4$ in the marker angle is obtained as $\theta_4=(\theta_3-\theta_2)$. After the differences (the amounts of the changes) have been computed (Step S39), the marker 120 that has been affixed onto the work cloth 100 may be peeled off the work cloth 100 by the user. The processing then advances to Step S41.

The second embroidery data for the second pattern that corresponds to the first pattern that has already been sewn is read out from the embroidery data table 2021 (Step S41). The second embroidery data that has been read out is stored in the selected data storage area 211 of the RAM 63. Next, the coordinate data in the second embroidery data that is stored in the selected data storage area 211 is converted based on the differences that have been computed at Step S39 (Step S43). The converted coordinate data is stored in the selected data storage area 211 as the coordinate data in the second embroidery data.

The conversion of the coordinate data may be performed as described below, for example. The second E1 data that has been read out from the embroidery data table 2021 is stored in the selected data storage area 211. The second E1 data that is stored in the selected data storage area 211 is converted based on the computed differences (Px, Py, $\theta_4$).

In a case where the coordinate data for the converted second E1 data is indicated as (Bx', By'), the coordinate data is obtained as follows.

$Bx'=(Bx-L1)\cos\theta_4-(By-M1)\sin\theta_4+L1+Px$ $By'=(Bx-L1)\sin\theta_4+(By-M1)\cos\theta_4+M1+Py$ The obtained coordinate data (Bx', By') is stored in the selected data storage area 211 of the RAM 63 as the coordinate data for the second E1 data.

As described above, the second embroidery data is converted based on the computed differences. The differences correspond to the distance that the work cloth 100 has been moved when the work cloth 100 was repositioned. The distance that the work cloth 100 has been moved is added to the coordinate data in the second embroidery data in a case where the work cloth 100 has been repositioned. Accordingly, the converted second embroidery data indicates the position that is adjacent to the first pattern that has already been sewn on the work cloth 100, even after the work cloth 100 has been repositioned.

For example, the coordinate data in the second E1 data before the conversion indicates coordinates that show positions that are shown by the broken lines in FIG. 14. On the other hand, in a case where the first embroidery data has not been converted at Step S7, the coordinate data in the second E1 data that has been converted based on the computed differences for the marker 120 whose image was captured indicate coordinates that shows positions that are shown by the broken lines in FIG. 17.

Next, a determination is made as to whether the first embroidery data has been converted at Step S7 (refer to FIG. 11) as a result of the sewing position, the sewing angle, and the like of the first pattern being changed from the default states (Step S45). If the first embroidery data has been converted (YES at Step S45), the second embroidery data is converted based on parameters for the conversion of the first embroidery data which has been used at Step S7 (Step S47). The converted coordinate data is stored in the selected data storage area 211 of the RAM 63 as the coordinate data in the second embroidery data. The processing then advances to Step S49. If the first embroidery data has not been converted (NO at Step S45), the processing advances to Step S49 without any particular processing performed.

At Step S47, the conversion of the second embroidery data may be performed as described below, for example. It is assumed that the parameter for the conversion of the first embroidery data is defined as (Ox, Oy, $\theta_1$), as shown, for example, in the method for converting the coordinate data at Step S7 (refer to FIG. 11). In a case where the coordinate data for the second E1 data for the second E1 pattern 143 that has been moved and rotated is indicated as (Bx", By"), the coordinate data is obtained as follows.

$$Bx''=(Bx'+Ox)\cos\theta_1-(By'+Oy)\sin\theta_1$$

$$By''=(Bx'+Ox)\sin\theta_1+(By'+Oy)\cos\theta_1$$

The obtained coordinate data (Bx", By") is stored in the selected data storage area 211 of the RAM 63 as the coordinate data for the second E1 data.

As described above, in a case where the coordinate data in the first embroidery data has been converted, the coordinate data in the second embroidery data is converted based on the conversion parameter that is used for the conversion of the first embroidery data. Accordingly, the coordinate data in the converted second embroidery data indicates the position that is adjacent to the first pattern that has been sewn based on the converted first embroidery data.

Next, a determination is made as to whether the sewing start-and-stop switch 21 has been pressed (Step S49). If the sewing start-and-stop switch 21 has not been pressed (NO at Step S49), a determination is made as to whether the panel operation for terminating the sewing processing has been performed (Step S53). If the panel operation for terminating the sewing processing has been performed (YES at Step S53), the sewing processing is terminated. If the panel operation for terminating the sewing processing has not been performed (NO at Step S53), the processing returns to Step S49. Then it is continuously determined whether the sewing start-and-stop switch 21 has been pressed.

If the sewing start-and-stop switch 21 has been pressed to start the work of sewing (YES at Step S49), processing for sewing the second E1 pattern 143 on the work cloth 100 is performed based on the converted second embroidery data that is stored in the selected data storage area 211 (Step S51). Thus the second pattern is sewn in the position that is adjacent to the first pattern on the work cloth 100 that is held by the embroidery frame 34. The sewing processing is then terminated.

Figure 18:
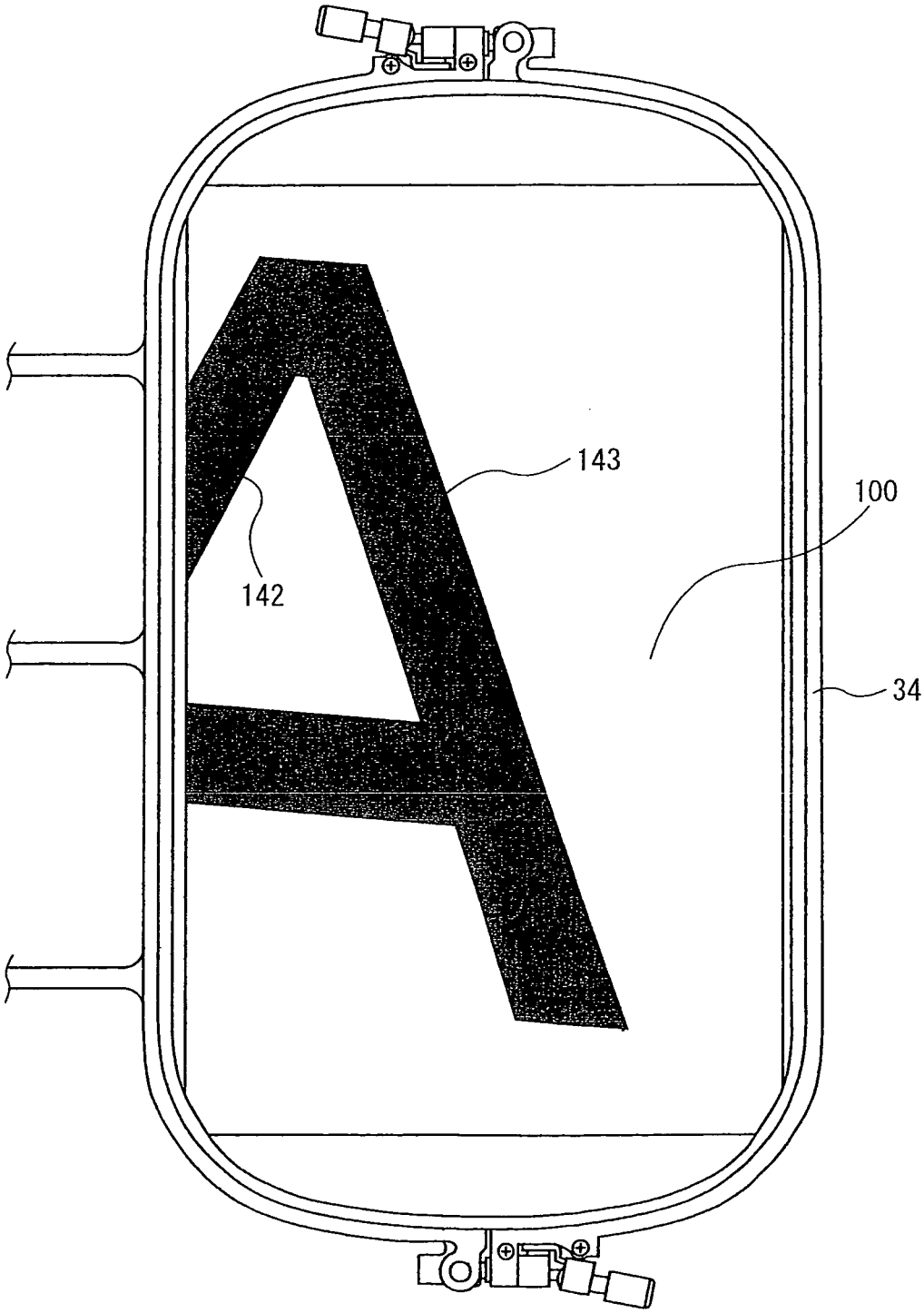
FIG. 18 is a figure that shows an example of a state in which the first E1 pattern and the second E1 pattern have been sewn in the work cloth.

An example of the work cloth 100 in a state in which the second E1 pattern 143 has been sewn after the first E1 pattern 142 was sewn will be explained with reference to FIG. 18. As shown in FIG. 18, the second E1 pattern 143 has been sewn on the work cloth 100 such that the second E1 pattern 143 abuts the right edge portion of the first E1 pattern 142 that has the shape of the left half of the letter "A". Because the coordinate data in the second E1 data has been converted based on the result of the detection of the marker 120 whose image was captured, the second E1 pattern 143 is sewn adjacent to the first E1 pattern 142 without any misalignment. This allows the E1 pattern 140 that has the shape of the letter "A" to be sewn on the work cloth 100.

As explained above, in the present embodiment, the distance that the work cloth 100 has been moved in relation to the embroidery frame 34 when the work cloth 100 was repositioned is detected. Based on the detected distance, the second embroidery data for the second pattern is converted. Based on the converted second embroidery data, the second pattern is sewn. This makes it possible for the separately sewn second pattern to be disposed adjacent to the first pattern that has already been sewn on the work cloth 100 without any misalignment. Therefore, even in a case where an embroidery pattern is divided into a plurality of sub-patterns and is sewn on the work cloth 100 in several batches, the sub-patterns may be positioned adjacent to one another without any misalignment. It is also possible to sew accurately an embroidery pattern that is too large to fit within the embroidery frame 34 in several batches.

An adhesive is applied to the marker 120 that is used for detecting the distance of movement. The marker 120 may be used by being affixed onto the work cloth 100. In a case where the marker 120 is no longer needed after the sewing has been performed, the marker 120 may be easily peeled off the work cloth 100. It is therefore possible to prevent the marker 120 from interfering with the sewing work. It is also easy to change the position of the marker 120.

The sewing machine 1 according to the present disclosure is not limited to the embodiment that is described above, and various modifications are possible. In the present embodiment, the embroidery pattern is divided into two sub-patterns in advance, and the embroidery data that correspond to each of the sub-patterns (the first embroidery data and the second embroidery data) is stored in the embroidery data table 2021. However, the number of the sub-patterns is not limited to two. The embroidery pattern may be divided into three sub-patterns in advance, and the embroidery data that correspond to each of the sub-patterns may be stored in the embroidery data table 2021.

For example, the embroidery pattern may not be divided in advance and only the embroidery data that corresponds to the entire embroidery pattern may be stored in the embroidery data table 2021. In a case where the embroidery pattern is divided into a plurality of sub-patterns and is sewn in several batches, the embroidery data that corresponds to each of the sub-patterns may be generated. The division of the embroidery pattern may be performed based on a panel operation by the user.

The sewing machine according to the present disclosure may be used in a case where an embroidery pattern of the letter "W" is repeatedly sewn on the work cloth 100 such that a plurality of the letters "W" are disposed adjacent to one another, for example "WWWWW". In such a case, the embroidery pattern "W" that is sewn first may be defined as the first pattern, and the "W" that is sewn next may be defined as the second pattern. In this case, the first pattern and the second pattern are the same, so the first embroidery data and the second embroidery data may be the same. After the first pattern "W" is sewn, the work cloth 100 may be repositioned as necessary. Then the distance that the work cloth 100 has been moved may be computed, and the coordinate data in the second embroidery data for the second pattern "W" that will be sewn next may be converted based on the computation result. After the second pattern "W" has been sewn, the same sort of processing may be repeated using the embroidery pattern "W" that will be sewn next as the second pattern. Thus a plurality of the embroidery pattern may be sewn adjacent to one another without any misalignment.

It may be not necessary to detect the marker angles and to compute the difference of the marker angles, depending on the way that the work cloth 100 is repositioned. In such a case, only the marker positions may be detected, and the difference of the marker positions may computed. Alternatively, only the marker angles may be detected, and the difference between the marker angles may be computed.

In the present embodiment, the embroidery frame 34 holds the work cloth 100 by clamping the work cloth 100 with the inner frame and the outer frame. For example, Japanese Laid-Open Patent Publication No. 2007-105138 discloses an embroidery frame and a detection device, the relevant portions of which are herein incorporated by reference. Although a detailed explanation is not given here, the embroidery frame that is described in the above publication is provided with an upper frame and a lower frame. A work cloth is clamped and held between the upper frame and the lower frame such that the work cloth is pressed from above and below. Furthermore, the embroidery frame that is described in the above publication includes a detection device that detects one of an edge of the work cloth and a reference line so that embroidery patterns may be continuously sewn. In the embroidery frame that is described in the above publication, when the work cloth is repositioned, it is possible to move the work cloth based on a detection result of the detection device. In such a case, parallel movement of the work cloth may be possible. In a case where the embroidery frame that is described in the above publication is used, it is not necessary to detect the marker angles and to compute the difference of the marker angles. Therefore only the marker positions may be detected and the difference of the marker positions may be computed.

In the present embodiment, the embroidery frame 34 is provided with a single attaching portion, which may be attached to and detached from the carriage of the embroidery frame transfer unit 92. However, a plurality of attaching portions may be provided in a plurality of positions where the embroidery frame 34 may be attached to and detached from the carriage. Alternatively, the relative position where the attaching portion may be attached to the carriage, that is, the position where the embroidery frame 34 may be attached to the carriage, may be modifiable. In such cases, the distance of movement of the work cloth 100 that is held by the embroidery frame 34 in relation to the carriage may be detected by using the image sensor 50 to capture an image of the marker 120 that has been affixed onto the work cloth 100.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine that is capable of sewing an embroidery pattern on a work cloth that an embroidery frame is configured to hold, the sewing machine comprising:

a transfer device that transfers the embroidery frame detachably attached thereto;

a storage device that stores embroidery data that is data for sewing the embroidery pattern and that includes at least coordinate data that indicates a plurality of needle drop positions in relation to a reference position, each of the plurality of needle drop positions being a point where a needle pierces the work cloth;

a first selection device that selects first embroidery data from the embroidery data that is stored in the storage device, the first embroidery data being embroidery data for a first pattern that is at least a portion of the embroidery pattern;

a first control device that performs sewing of the first pattern on the work cloth by controlling the transfer device based on the first embroidery data that was selected by the first selection device;

an image capture device that captures an image of the work cloth onto which a marker that can be affixed onto the work cloth is affixed;

a first detection device that detects at least one of a first marker position and a first marker angle based on information for a first image, the first marker position being a position of the marker that has been affixed onto the work cloth in relation to the reference position, the first marker angle being an angle of the marker in relation to a reference direction, and the first image being an image captured by the image capture device of the work cloth on which the first pattern has been sewn by the first control device;

a second detection device that detects at least one of a second marker position and a second marker angle based on information for a second image, the second marker position being a position of the marker that has been affixed onto the work cloth in relation to the reference position, the second marker angle being an angle of the marker in relation to the reference direction, the second image being an image captured by the image capture device of the work cloth one of after a position of the work cloth on which the first pattern has been sewn has been changed in relation to the embroidery frame and after a position of the embroidery frame that holds the work cloth on which the first pattern has been sewn has been changed in relation to the transfer device;

a difference computation device that computes at least one of a position difference and an angle difference, the position difference being a difference between the first marker position that was detected by the first detection device and the second marker position that was detected by the second detection device, and the angle difference being a difference between the first marker angle that was detected by the first detection device and the second marker angle that was detected by the second detection device;

a second selection device that selects second embroidery data from the embroidery data that is stored in the storage device, the second embroidery data being embroidery data for a second pattern that is at least a portion of the embroidery pattern and that is adjacent to the first pattern;

a conversion device that converts coordinate data in the second embroidery data based on the at least one of the position difference and the angle difference that was computed by the difference computation device; and a second control device that performs sewing of the second pattern on the work cloth on which the first pattern has been sewn by controlling the transfer device based on the second embroidery data that includes the coordinate data that was converted by the conversion device.

2. The sewing machine according to claim 1, wherein the marker can be peeled off the work cloth.

3. A computer-readable medium storing a control program executable on a sewing machine that is capable of sewing an embroidery pattern on a work cloth that an embroidery frame is configured to hold, the program comprising instructions that cause a computer to perform the steps of:

selecting first embroidery data from embroidery data that is data for sewing the embroidery pattern and that includes at least coordinate data that indicates a plurality of needle drop positions in relation to a reference position, the first embroidery data being embroidery data for a first pattern that is at least a portion of the embroidery pattern, and each of the plurality of needle drop positions being a point where a needle pierces the work cloth;

performing sewing of the first pattern on the work cloth by controlling a transfer device based on the selected first embroidery data, the transfer device transferring the embroidery frame detachably attached thereto;

detecting at least one of a first marker position and a first marker angle based on information for a first image, the first marker position being a position of the marker that has been affixed onto the work cloth in relation to the reference position, the first marker angle being an angle of the marker in relation to a reference direction, and the first image being a captured image of the work cloth on which the first pattern has been sewn;

detecting at least one of a second marker position and a second marker angle based on information for a second image, the second marker position being a position of the marker that has been affixed onto the work cloth in relation to the reference position, the second marker angle being an angle of the marker in relation to the reference direction, the second image being a captured image of the work cloth one of after a position of the work cloth on which the first pattern has been sewn has been changed in relation to the embroidery frame and after a position of the embroidery frame that holds the work cloth on which the first pattern has been sewn has been changed in relation to the transfer device;

computing at least one of a position difference and an angle difference, the position difference being a difference between the first marker position that was detected based on the information for the first image and the second marker position that was detected based on the information for the second image, and the angle difference being a difference between the first marker angle that was detected based on the information for the first image and the second marker angle that was detected based on the information for the second image;

selecting a second embroidery data from the embroidery data, the second embroidery data being embroidery data for a second pattern that is at least a portion of the embroidery pattern and that is adjacent to the first pattern;

converting coordinate data in the second embroidery data based on the at least one of the computed position difference and the computed angle difference; and performing sewing of the second pattern on the work cloth on which the first pattern has been sewn by controlling the transfer device based on the second embroidery data that includes the converted coordinate data.

4. A sewing machine that is capable of sewing an embroidery pattern on a work cloth that an embroidery frame is configured to hold, the sewing machine comprising:

transfer means for transferring the embroidery frame detachably attached thereto;

storage means for storing embroidery data that is data for sewing the embroidery pattern and that includes at least coordinate data that indicates a plurality of needle drop positions in relation to a reference position, each of the plurality of needle drop positions being a point where a needle pierces the work cloth;

first selection means for selecting first embroidery data from the embroidery data that is stored in the storage means, the first embroidery data being embroidery data for a first pattern that is at least a portion of the embroidery pattern;

first control means for performing sewing of the first pattern on the work cloth by controlling the transfer means based on the first embroidery data that was selected by the first selection means;

image capture means for capturing an image of the work cloth onto which a marker that can be affixed onto the work cloth is affixed;

first detection means for detecting at least one of a first marker position and a first marker angle based on information for a first image, the first marker position being a position of the first marker that has been affixed onto the work cloth in relation to the reference position, the marker angle being an angle of the marker in relation to a reference direction, and the first image being an image captured by the image capture means of the work cloth on which the first pattern has been sewn by the first control means;

second detection means for detecting at least one of a second marker position and a second marker angle based on information for a second image, the second marker position being a position of the marker that has been affixed onto the work cloth in relation to the reference position, the second marker angle being an angle of the marker in relation to the reference direction, the second image being an image captured by the image capture means of the work cloth one of after a position of the work cloth on which the first pattern has been sewn has been changed in relation to the embroidery frame and after a position of the embroidery frame that holds the work cloth on which the first pattern has been sewn has been changed in relation to the transfer means;

difference computation means for computing at least one of a position difference and an angle difference, the position difference being a difference between the first marker position that was detected by the first detection means and the second marker position that was detected by the second detection means, and the angle difference being a difference between the first marker angle that was detected by the first detection means and the second marker angle that was detected by the second detection means;

second selection means for selecting second embroidery data from the embroidery data that is stored in the storage means, the second embroidery data being embroidery data for a second pattern that is at least a portion of the embroidery pattern and that is adjacent to the first pattern;

conversion means for converting coordinate data in the second embroidery data based on the at least one of the position difference and the angle difference that was computed by the difference computation means; and second control means for performing sewing of the second pattern on the work cloth on which the first pattern has been sewn by controlling the transfer means based on the second embroidery data that includes the coordinate data that was converted by the conversion means.

5. The sewing machine according to claim 4, wherein the marker can be peeled off the work cloth.

* * * * *